US009903370B2

(12) United States Patent
Tsuka et al.

(10) Patent No.: US 9,903,370 B2
(45) Date of Patent: Feb. 27, 2018

(54) SCROLL COMPRESSOR WITH REDUCED UPSETTING MOMENT

(71) Applicant: DAIKIN INDUSTRIES, LTD., Osaka-shi, Osaka (JP)

(72) Inventors: Yoshitomo Tsuka, Sakai (JP); Youhei Nishide, Sakai (JP); Masateru Yamamoto, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 295 days.

(21) Appl. No.: 14/814,263

(22) Filed: Jul. 30, 2015

(65) Prior Publication Data

US 2015/0337839 A1 Nov. 26, 2015

Related U.S. Application Data

(63) Continuation of application No. 13/881,858, filed as application No. PCT/JP2011/005812 on Oct. 18, 2011, now Pat. No. 9,127,669.

(30) Foreign Application Priority Data

Nov. 1, 2010 (JP) ..... 2010-245260

(51) Int. Cl.
*F04C 29/00* (2006.01)
*F04C 29/02* (2006.01)
(Continued)

(52) U.S. Cl.
CPC ..... *F04C 29/0021* (2013.01); *F04C 2/00* (2013.01); *F04C 18/0215* (2013.01);
(Continued)

(58) Field of Classification Search
CPC ..... F04C 29/0021; F04C 29/0028; F04C 29/0035; F04C 29/028; F04C 18/0215; F04C 18/0261; F04C 18/0253
See application file for complete search history.

(56) References Cited

U.S. PATENT DOCUMENTS 4,384,831 A 5/1983 Ikegawa et al.
6,287,096 B1 9/2001 Nakane et al.
(Continued)

FOREIGN PATENT DOCUMENTS

EP 1508699 A1 2/2005
JP 2003-328963 A 11/2003
(Continued)

OTHER PUBLICATIONS

International Search Report of corresponding PCT Application No. PCT/JP2011/005812 dated May 23, 2013.
(Continued)

*Primary Examiner* — Mark Laurenzi
*Assistant Examiner* — Xiaoting Hu
(74) *Attorney, Agent, or Firm* — Global IP Counselors, LLP

(57) ABSTRACT

A scroll compressor includes a pressing mechanism, a pushback mechanism and an adjustment mechanism. The pressing mechanism applies a pressing force toward a fixed scroll to the back side of an end plate portion of an orbiting scroll. The pushback mechanism applies a pushback force separating the orbiting scroll from a fixed scroll to the front of the orbiting scroll. The adjusting mechanism has a low-pressure portion filled with a fluid of a lower pressure than the discharge pressure of the compression mechanism, and a communicating groove formed in a sliding surface of an outer peripheral portion of the fixed scroll so as to communicate with the low-pressure portion in a first rotational angle range in order to reduce an upsetting moment of the orbiting scroll, and to be blocked from the low-pressure portion in a second rotational angle range other than the first rotational angle range.

2 Claims, 15 Drawing Sheets

(51) Int. Cl.

| | |
|---|---|
| ***F04C 18/02*** | (2006.01) |
| ***F04C 23/00*** | (2006.01) |
| ***F04C 27/00*** | (2006.01) |
| ***F04C 2/00*** | (2006.01) |

(52) U.S. Cl.
CPC ..... *F04C 18/0253* (2013.01); *F04C 18/0261* (2013.01); *F04C 23/008* (2013.01); *F04C 27/006* (2013.01); *F04C 29/028* (2013.01)

(56) References Cited

U.S. PATENT DOCUMENTS

| | | | | |
|---|---|---|---|---|
| 6,533,561 | B1 * | 3/2003 | Furusho | F04C 27/005 418/55.4 |
| 2004/0265159 | A1 * | 12/2004 | Furusho | F04C 18/0215 418/55.5 |
| 2006/0210416 | A1 | 9/2006 | Morimoto et al. | |
| 2007/0092390 | A1 * | 4/2007 | Ignatiev | F04C 18/0215 418/55.5 |
| 2010/0092321 | A1 * | 4/2010 | Kim | F04C 18/0253 418/55.6 |
| 2010/0129240 | A1 | 5/2010 | Shiibayashi et al. | |
| 2010/0177521 | A1 | 7/2010 | Lee | |
| 2011/0158838 | A1 * | 6/2011 | Nishide | F04C 18/0215 418/55.1 |
| 2011/0158858 | A1 | 6/2011 | Alves Ramalho Gomes | |

FOREIGN PATENT DOCUMENTS

| | | | |
|---|---|---|---|
| JP | 3731433 | B2 | 10/2005 |
| JP | 2011-12621 | A | 1/2011 |

OTHER PUBLICATIONS

European Search Report of corresponding EP Application No. 11 83 7716.7 dated Feb. 25, 2014.

* cited by examiner

SCROLL COMPRESSOR WITH REDUCED UPSETTING MOMENT

CROSS-REFERENCE TO RELATED APPLICATIONS

This application is a divisional application of U.S. patent application Ser. No. 13/881,858 filed on Apr. 26, 2013, which is a National Stage application of International Patent Application No. PCT/JP2011/005812 filed on Oct. 18, 2011. The entire disclosure of U.S. patent application Ser. No. 13/881,858 is hereby incorporated herein by reference.

TECHNICAL FIELD

The present invention relates to a scroll compressor, and more particularly to an upsetting prevention measure of an orbiting scroll.

BACKGROUND ART

Conventionally, scroll compressors have been known as compressors for compressing fluid. For example, Japanese Patent No. 3731433 discloses a scroll compressor of this kind. The scroll compressor contains a compression mechanism in which a fixed scroll and an orbiting scroll are meshed with each other in a casing. The orbiting scroll rotates eccentrically about the fixed scroll by a motor. Thereby, the fluid sucked into a compression chamber from the vicinity of the outer periphery of the fixed scroll flows near to a discharge port on the center side of the fixed scroll while the volume of the compression chamber gradually decreases. Thus, when the compression chamber with the fluid compressed therein communicates with the discharge port, the fluid is discharged from the discharge port.

The scroll compressor disclosed in the Japanese Patent No. 3731433 includes a pressing mechanism for pressing the orbiting scroll toward the fixed scroll. Specifically, this pressing mechanism applies discharge pressure (high pressure) to the back side of an end plate portion of the orbiting scroll. This lightens the upsetting moment applied to the orbiting scroll resulting from the gas pressure (gas load in a thrust direction or radial direction) in the compression chamber.

Meanwhile, in the configuration having such a pressing mechanism, the high pressure applied to the back side of the end plate portion of the orbiting scroll increases, under the operating condition that the pressure differential between high and low pressure regions of the fluid is especially large. Therefore, the pressing force of the orbiting scroll is increased, and the sliding loss in the thrust direction between the fixed scroll and the orbiting scroll is increased.

Thus, the scroll compressor disclosed in the Japanese Patent No. 3731433 is provided with a pushback mechanism for suppressing such an excessive pressing force. Specifically, in the pushback mechanism disclosed in the Japanese Patent No. 3731433, a high-pressure inlet groove is formed in a sliding surface between the outer periphery of the fixed scroll and the end plate portion of the orbiting scroll. For example, under the operating condition that the pressure differential between high and low pressure regions is large, when high pressure lubricating oil is supplied to the high-pressure groove, a pushback force (separating force) which axially separates both scrolls is generated between the fixed scroll and the orbiting scroll. As a result, it is possible to suppress the pressing by the excessive pressing mechanism and the sliding loss in the thrust direction is reduced.

SUMMARY

However, the above-mentioned pushback mechanism cannot apply a pushback force uniformly across the whole area of the end plate portion of the orbiting scroll, due to constraints such as a size or shape of the compression mechanism. Therefore, with such unevenness of the pushback force, the upsetting moment fluctuates greatly depending on the rotational angle of the orbiting scroll. Consequently, even if the above-mentioned pushback mechanism is used, the upsetting moment increases when the orbiting scroll reaches a certain rotational angle range.

The present invention has been made in view of the foregoing point, and an object thereof is to provide a scroll compressor that can reduce an upsetting moment regardless of the rotational angle of the orbiting scroll.

A first aspect of the invention is directed to a scroll compressor including: a casing (20); a compression mechanism (40) which is contained in the casing (20), and includes a fixed scroll (60) having an end plate portion (61), an outer peripheral portion (62) formed on an outer periphery of the end plate portion (61), and a wrap (63) placed upright inside the outer peripheral portion (62), and an orbiting scroll (70) having an end plate portion (71) slidably contacting with the outer peripheral portion (62) of the fixed scroll (60) and a front end portion of the wrap (63) of the fixed scroll (60), and a wrap (72) placed upright on the end plate portion (71); a pressing mechanism (42) which applies a pressing force toward the fixed scroll (60) to a back side of the end plate portion (71) of the orbiting scroll (70); a pushback mechanism (80) which applies a pushback force separating the orbiting scroll (70) from the fixed scroll (60) to a front of the end plate portion (71) of the orbiting scroll (70); and at least one adjusting mechanism (120) having a low-pressure portion (12*a*, 43, 44) filled with a fluid of lower pressure than a discharge pressure of the compression mechanism (40), and a communicating groove (90, 96, 101, 102) formed in a sliding surface of the outer peripheral portion (62) of the fixed scroll (60) so as to communicate with the low-pressure portion (12*a*, 43, 44) in a first rotational angle range for reducing an upsetting moment of the orbiting scroll (70), and to be blocked from the low-pressure portion (12*a*, 43, 44) in a second rotational angle range other than the first rotational angle range.

In the first aspect of the invention, when the orbiting scroll (70) performs a revolving motion about the fixed scroll (60), the fluid is compressed in a compression chamber formed between the two scrolls (60, 70). The pressing mechanism (42) applies a pressing force to the back side of the end plate portion (71) of the orbiting scroll (70). By this, the orbiting scroll (70) is pressed toward the fixed scroll (60) against the gas load in the compression chamber. As a result, upsetting of the orbiting scroll (70) is inhibited.

For example, when such a pressing force is excessive, the pushback mechanism (80) applies a pushback force to the front of the end plate portion (71) of the orbiting scroll (70). That is, the pushback mechanism (80) pushes back the orbiting scroll (70) in the direction opposite to the pressing force of the pressing mechanism (42). By this, under such an operating condition that the pressure differential between high and low pressure regions is large, the excessive pressing force of the orbiting scroll (70) is suppressed.

Meanwhile, if a pushback force is applied to the end plate portion (71) of the orbiting scroll (70) by such a pushback mechanism (80), the upsetting moment is increased when the rotational angle of the orbiting scroll (70) reaches a certain range. Thus, the present invention is provided with the adjusting mechanism (120) for reducing the upsetting moment in the first rotational angle range in which the upsetting moment of the orbiting scroll (70) is increased.

Specifically, the communicating groove (90, 96, 101, 102) is formed in the outer peripheral portion (62) of the fixed scroll (60) in the adjusting mechanism (120). When the orbiting scroll (70) reaches the first rotational angle range, the communicating groove (90, 96, 101, 102) communicates with the low-pressure portion (12*a*, 43, 44). The low-pressure portion (12*a*, 43, 44) is filled with the fluid of the pressure lower than the discharge pressure of the compression mechanism (40) (for example, the suction pressure of the compression mechanism (40) or the intermediate pressure between the suction pressure and the discharge pressure). Therefore, when the communicating groove (90, 96, 101, 102) communicates with the low-pressure portion (12*a*, 43, 44), the pressure in the communicating groove (90, 96, 101, 102) also decreases. As a result, the end plate portion (71) of the orbiting scroll (70) is sucked toward the outer peripheral portion (62) of the fixed scroll (60). That is, the pressure of the communicating groove (90, 96, 101, 102) is lowered, so that negative pressure is applied to the end plate portion (71) of the orbiting scroll (70). By this, in the first rotational angle range, the orbiting scroll (70) is attracted toward the fixed scroll (60) to reduce the upsetting moment. By this, the upsetting moment of the orbiting scroll (70) is offset in the first rotational angle range.

Meanwhile, when the orbiting scroll (70) is in the second rotational angle range (that is, the rotational angle range remaining after subtracting the first rotational angle range from the rotational angle range of 360° per one rotation of the orbiting scroll) other than the first rotational angle range, the communicating groove (90, 96, 101, 102) and the low-pressure portion (12*a*, 43, 44) is blocked. Because the internal pressure of the communicating groove (90, 96, 101, 102) is not lowered in this second rotational angle range, the upsetting moment of the orbiting scroll (70) is not reduced positively by the adjusting mechanism (120).

According to a second aspect of the invention, in the scroll compressor of the first aspect of the invention, the pushback mechanism (80) includes a high-pressure side oil groove (80) which is formed in the sliding surface of the outer peripheral portion (62) of the fixed scroll (60) and into which a lubricating oil with a high pressure corresponding to the discharge pressure of the compression mechanism (40) flows, and the communicating groove (90, 96) is formed on the outside in a radial direction of the high-pressure side oil groove (80).

In the pushback mechanism (80) of the second aspect of the invention, the high-pressure side oil groove (80) of an arc shape is formed in the sliding surface of the outer peripheral portion (62) of the fixed scroll (60). When high pressure lubricating oil is introduced into this high-pressure side oil groove (80), a pushback force is applied to the portion facing the high-pressure side oil groove (80) (a part of the front of the end plate portion (71) of the orbiting scroll (70)). Meanwhile, the communicating groove (90, 96) for reducing the upsetting moment is formed in the sliding surface of the outer peripheral portion (62) of the fixed scroll (60) on the outside in the radial direction of the high-pressure side oil groove (80). Thus, even if the lubricating oil in the high-pressure side oil groove (80) leaks out in the radial direction of the fixed scroll (60) in the configuration where the high-pressure side oil groove (80) and communicating groove (90, 96) are disposed, the lubricating oil can be collected into the communicating groove (90, 96).

In a third aspect of the invention, the high-pressure side oil groove (80) is formed in an arc shape. Therefore, a pushback three is applied to the end plate portion (71) of the orbiting scroll (70) across a relatively wide range. Meanwhile, the communicating groove (90, 96) is formed in an arc shape so as to run along the arc of the high-pressure side oil groove (80). Therefore, when the lubricating oil in the high-pressure side oil groove (80) leaks out in the radial direction of the fixed scroll (60), it becomes easy to collect the lubricating oil into the communicating groove (90, 96).

According to a fourth aspect of the invention, in the scroll compressor of any one of the first to third aspects of the invention, the adjusting mechanism (120) includes a concave recess (94) formed in a sliding surface to the outer peripheral portion (62) in the end plate portion (71) of the orbiting scroll (70) and a suction port (12*a*) as the low-pressure portion for sucking the fluid into the compression mechanism (40), and is configured such that when the orbiting scroll (70) comes into the first rotational angle range, an inside of the concave recess (94) comes to be in a position at which the concave recess (94) communicates with both of the suction port (12*a*) and the communicating groove (90), and when the orbiting scroll (70) comes into the second rotational angle range, the inside of the communicating concave recess (94) comes to have a position blocked from either or both of the suction port (12*a*) and the communicating groove (90).

In the adjusting mechanism (120) of the fourth aspect of the invention, the concave recess (94) is formed in the sliding surface of the end plate portion (71) of the orbiting scroll (70). Therefore, when the orbiting scroll (70) performs a revolving motion, the concave recess (94) also performs a revolving motion together with the end plate portion (71). When the orbiting scroll (70) comes into the first rotational angle range, the concave recess (94) is displaced into a position at which the concave recess (94) communicates with both of the suction port (12*a*) of the compression mechanism (40) and the communicating groove (90). Then, the communicating groove (90) communicates with the suction port (12*a*) through the internal space of the concave recess (94). Thereby, the pressure in the communicating groove (90) is lowered, and the orbiting scroll (70) is attracted toward the fixed scroll (60).

When the orbiting scroll (70) comes into the second rotational angle range, the concave recess (94) is displaced into a position that does not communicate with the communicating groove (90) or the suction port (12*a*). Therefore, the internal pressure of the communicating groove (90) is not lowered in the second rotational angle range.

According to a fifth aspect of the invention, in the scroll compressor of any one of the first to third aspects of the invention, the adjusting mechanism (120) includes a closed portion (71*a*) formed at an outer peripheral end of the end plate portion (71) of the orbiting scroll (70) to be displaced so as to open and close the communicating groove (96), and the low-pressure portion (43) formed around the closed portion (71*a*), and is configured such that when the orbiting scroll (70) comes into the first rotational angle range, the communicating groove (96) is opened from the closed portion (71*a*) to make the communicating groove (96) communicate with the low-pressure portion (43), and when the orbiting scroll (70) comes into the second rotational angle range, the communicating groove (96) is covered with the closed portion (71*a*) of the orbiting scroll (70).

In the fifth aspect of the invention, as the closed portion (71*a*) is displaced according to the revolving motion of the orbiting scroll (70), the pressure of the communicating groove (96) is adjusted. Specifically, when the orbiting scroll (70) comes into the first rotational angle range, the communicating groove (96) is opened from the closed portion (71*a*) (outer peripheral end of the end plate portion (71) of the orbiting scroll (70)). Then, the communicating groove (96) communicates with the low-pressure portion (43) around the closed portion (71*a*). Thereby, the pressure in the communicating groove (96) is lowered, and the orbiting scroll (70) is attracted toward the fixed scroll (60).

When the orbiting scroll (70) comes into the second rotational angle range, the communicating groove (96) is closed by the closed portion (71*a*) and is blocked from the low-pressure portion (43). Therefore, the internal pressure of the communicating groove (96) is not lowered in the second rotational angle range.

According to a sixth aspect of the invention, in the scroll compressor of any one of the first to third aspects of the invention, the adjusting mechanism (120) includes a through hole (98) penetrating the end plate portion (71) of the orbiting scroll (70) in an axial direction, and the low-pressure portion (44) communicating with the opening end on the back side of the end plate portion (71) in the through hole (98), and is configured such that when the orbiting scroll (70) comes into the first rotational angle range, the communicating groove (96) communicates with the low-pressure portion (44) through the through hole (98), and when the orbiting scroll (70) comes into the second rotational angle range, the communicating groove (96) and the through hole (98) are blocked.

In the sixth aspect of the invention, as the through hole (98) is displaced according to the revolving motion of the orbiting scroll (70), the pressure of the communicating groove (90, 96, 101, 102) is adjusted. Specifically, when the orbiting scroll (70) comes into the first rotational angle range, the communicating groove (90, 96, 101, 102) communicates with the tow-pressure portion (44) through the through hole (98). Thereby, the pressure in the communicating groove (90, 96, 101, 102) is lowered, and the orbiting scroll (70) is attracted toward the fixed scroll (60).

When the orbiting scroll (70) comes into the second rotational angle range, the communicating groove (90, 96, 101, 102) and the through hole (98) are blocked, and the communicating groove (90, 96, 101, 102) and the low-pressure portion (44) are thereby blocked. Therefore, the internal pressure of the communicating groove (90, 96, 101, 102) is not lowered in the second rotational angle range.

According to a seventh aspect of the invention, in the scroll compressor of the sixth aspect of the invention, the communicating groove (90, 96) includes an extended arc groove (100) of a shape overlapped in an axial direction of the through hole (98) with a part of an eccentric trajectory of the through hole (98), and the low-pressure portion (44) is formed in a range including the extended arc groove (100) in a cross-sectional view perpendicular to the axial direction of the through hole (98).

In the seventh aspect of the invention, an enlarged arc groove (100) is provided in the communicating groove (90, 96). This enlarged arc groove (100) has an arc shape to include a part of the eccentric trajectory of the through hole (98) rotating eccentrically according to the revolving motion of the orbiting scroll (70). Therefore, the time fir the communicating groove (90, 96) and the through hole (98) to communicate with each other can be made longer according to the length of arc of the enlarged arc groove (100). Thereby, the time for maintaining the communicating groove (90, 96) at low pressure also becomes longer, and further, the time for attracting the orbiting scroll (70) toward the fixed scroll (60) becomes longer.

According to the present invention, there are provided a communicating groove (90, 96, 101, 102) formed in a sliding surface of an outer peripheral portion (62) of a fixed scroll (60), so when an orbiting scroll (70) comes into a first rotational angle range, the communicating groove (90, 96, 101, 102) becomes able to communicate with a low-pressure portion (12*a*, 43, 44). Therefore, the orbiting scroll (70) can be attracted toward the fixed scroll (60) in a rotational angle range in which an upsetting moment becomes larger (that is, the first rotational angle range) resulting from a pushback force by a pushback mechanism (80). As a result, it is possible to avoid increasing the upsetting moment according to the rotational angle of the orbiting scroll (70).

Since the upsetting of the orbiting scroll (70) can be prevented in this way, it is possible to avoid enlarging the gap between the orbiting scroll (70) and fixed scroll (60), and for example, refrigerant leaking from such a gap can be prevented. Further, it is not necessary to supply a large amount of oil to fill up such a gap. In addition, since a large amount of oil flows into the compression chamber from the gap, a phenomenon of sucked refrigerant being heated excessively, so-called suction superheating of refrigerant, can be avoided.

In the second aspect of the invention, because the communicating groove (90, 96) is disposed on the outside in a radial direction of a high-pressure side oil groove (80) of the pushback mechanism, oil leaking out in the radial direction from the high-pressure side oil groove (80) can be collected in the communicating groove (90, 96). Thereby, for example, it is possible to inhibit the oil of the high-pressure side oil groove (80) leaking to the outer periphery of the orbiting scroll (70). If oil leaks to the outer periphery of the orbiting scroll (70), the oil acts as resistance to the orbiting scroll (70) or an Oldham coupling, for example, when the orbiting scroll (70) is revolving. As a result, power needed to make the orbiting scroll (70) revolve increases. However, as described above, if the oil of the high-pressure side oil groove (80) is collected into the communicating groove (90, 96), the loss of power due to the leaking of oil can be reduced.

Especially, in the third aspect of the invention, the high-pressure side oil groove (80) is formed in an arc shape, and the communicating groove (90, 96) is formed in the high-pressure groove on the outside of the radial direction so as to run along the arc of the high-pressure side oil groove (80). Therefore, oil leaking out in the radial direction from the inside of the high-pressure side oil groove (80) can be more reliably collected in the communicating groove (90, 96).

In the fourth aspect of the invention, a concave recess (94) is formed in the sliding surface of the orbiting scroll (70) and the communicating groove (90) and a suction port (12*a*) communicate with each other through the concave recess (94). Therefore, the pressure of the communicating groove (90) can be reliably lowered at a desired rotational angle (that is, the first rotational angle) at which the upsetting moment is easy to increase. In addition, as described above, when oil that leaked from the high-pressure side oil groove (80) is replenished in the communicating groove (90), this oil can be returned to the suction port (12*a*) of the compression mechanism (40) through the concave recess (94). Accordingly, the oil returned to the suction port (12*a*) can be used to lubricate each sliding portion in the compression chamber or to seal the gap.

In the fifth aspect of the invention, by using a closed portion (71*a*) formed at the outer peripheral end of the end plate portion (71) of the orbiting scroll (70), the communicating groove (96) can be easily opened and closed according to the revolving motion of the orbiting scroll (70). That is, the present invention can prevent the upsetting of the orbiting scroll (70) by a relatively simple structure.

In the sixth aspect of the invention, since a through hole (98) is formed in the end plate portion (71) of the orbiting scroll (70), the pressure in the communicating groove (90, 96, 101, 102) can be lowered by relatively easy processing. Especially, in the seventh aspect of the invention, since an enlarged arc groove (100) is formed in the communicating groove (90, 96), it is possible to adjust the communicating time between the communicating groove (90, 96) and the through hole (98) by the length of arc of the enlarged arc groove (100). Therefore, it is possible to more precisely reduce the increase of a localized upsetting moment resulting from the revolution of the orbiting scroll (70).

DESCRIPTION OF EMBODIMENTS

Embodiments of the present invention will be more particularly described hereinafter with reference to the drawings.

First Embodiment

A scroll compressor (10) according to a first embodiment is connected to a refrigerant circuit of a refrigeration system. That is, as a refrigerant compressed in the scroll compressor (10) circulates the refrigerant circuit in the refrigeration system, a vapor compression refrigeration cycle is performed.

Figure 1:
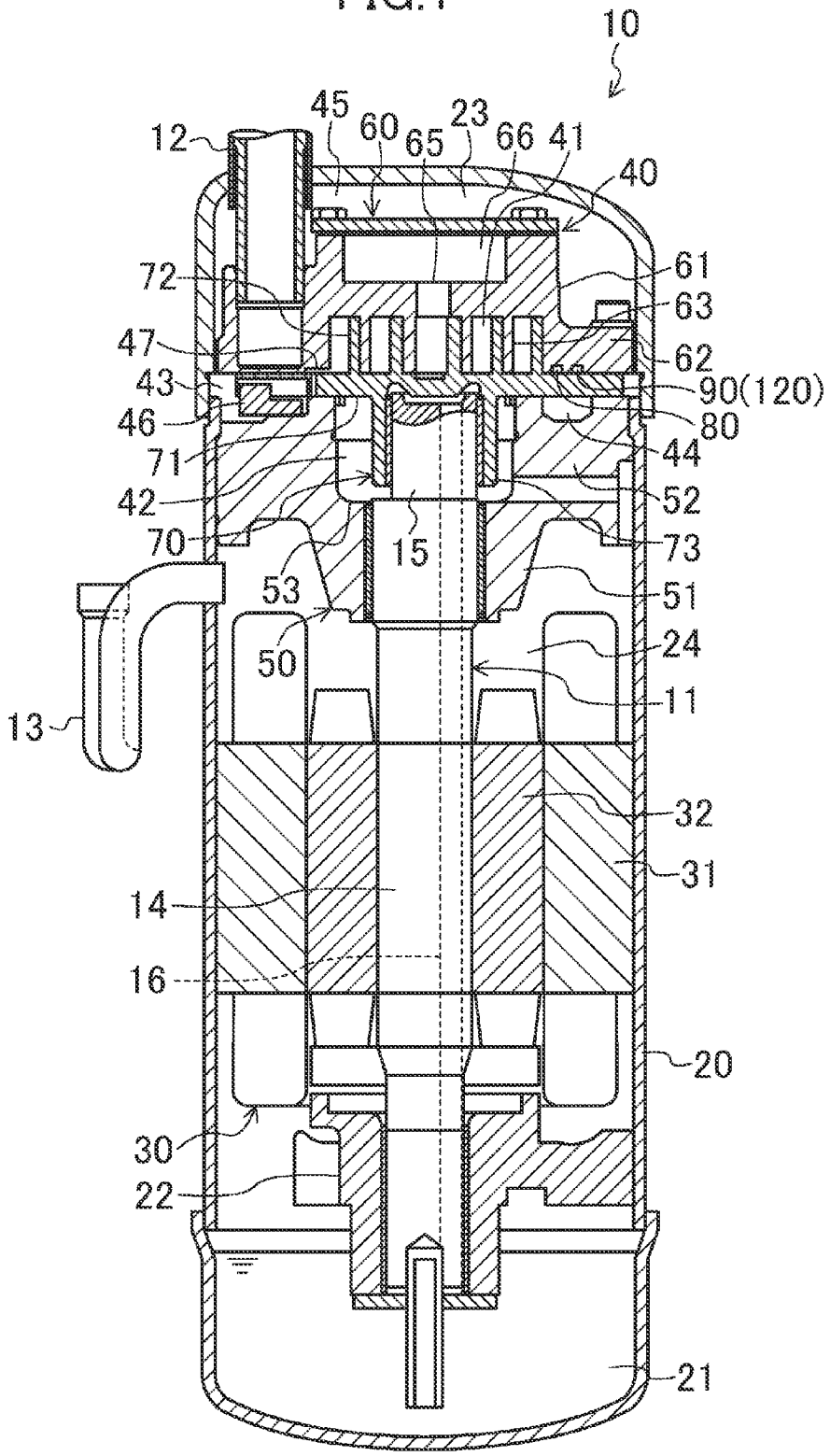
FIG. 1 is a longitudinal cross-sectional view of a scroll compressor of a first embodiment.
Figure 2:
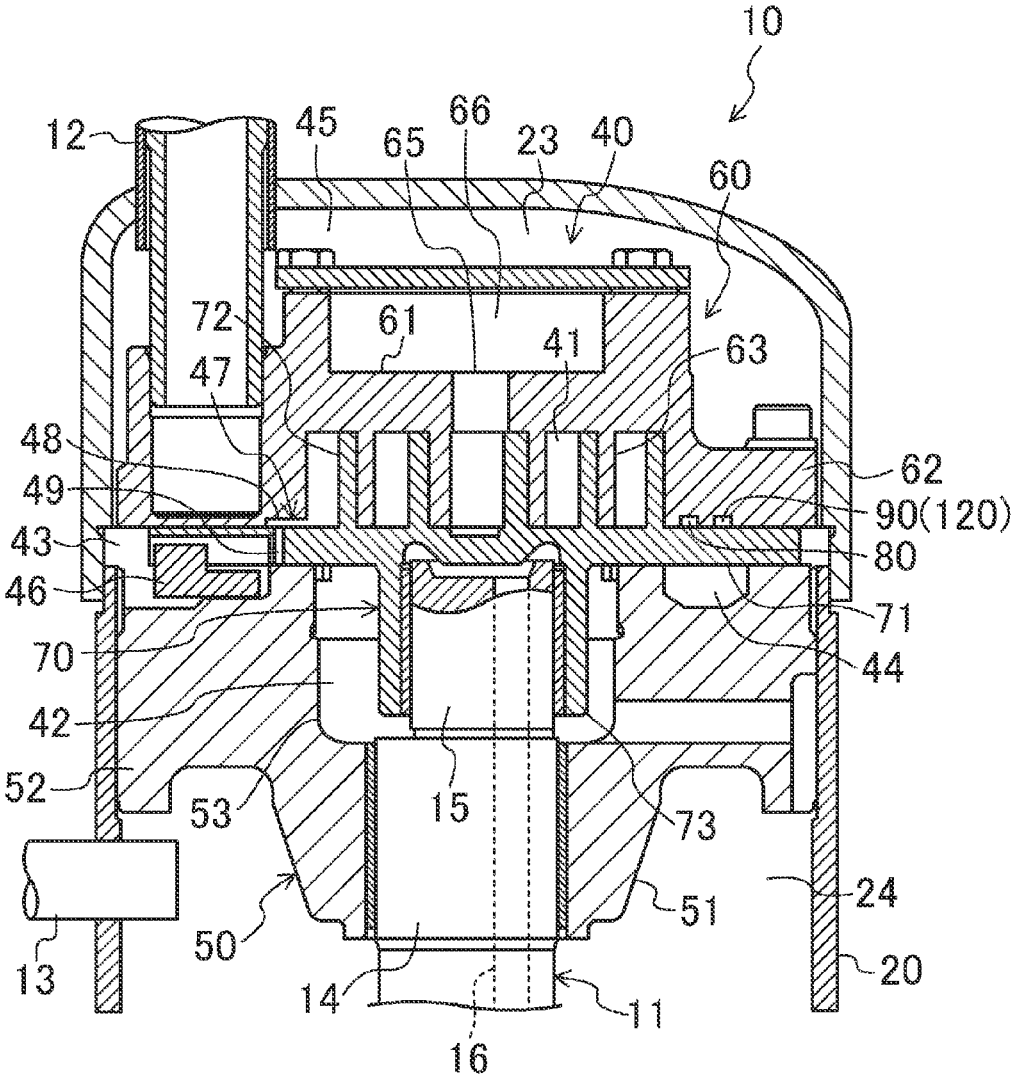
FIG. 2 is a longitudinal cross-sectional view of an essential part of the scroll compressor of the first embodiment.

As illustrated in FIGS. 1 and 2, the scroll compressor (10) includes a casing (20), and a motor (30) and a compression mechanism (40) contained in the casing (20). The casing (20) is formed in a vertically long cylinder shape, and is composed of a closed dome.

The motor (30) forms a driving mechanism that drives the compression mechanism (40) by rotating a drive shaft (11). The motor (30) includes a stator (31) fixed to the casing (20) and a rotor (32) disposed on the inside of the stator (31). The drive shaft (11) passes through the rotor (32), and then the rotor (32) is fixed to the drive shaft (11).

The bottom of the casing (20) includes an oil storage portion (21) in which lubricating oil is stored. In addition, a suction pipe (12) is attached to the casing (20) to pass through the top thereof, and a discharge pipe (13) is connected to the central portion of the casing (20).

A housing (50) is fixed to the casing (20) above the motor (30), and the compression mechanism (40) is installed above the housing (50). In addition, an inflow end of the discharge pipe (13) is disposed between the motor (30) and the housing (50).

The drive shaft (11) is disposed vertically along the casing (20), and includes a main shaft portion (14) and an eccentric portion (15) connected to an upper end of the main shaft portion (14). The lower part of the main shaft portion (14) is supported on a lower bearing (22) fixed on the casing (20), and the upper part of the main shaft portion (14) which passes through the housing (50) is supported on an upper bearing (51) of the housing (50).

The compression mechanism (40) includes a fixed scroll (60) which is fixed to the upper side of the housing (50) and an orbiting scroll (70) to mesh with the fixed scroll (60). The orbiting scroll (70) is installed in the housing (50) to be disposed between the fixed scroll (60) and the housing (50).

The housing (50) includes a ring portion (52) formed at the outer periphery thereof, a large-diameter groove (53) which has a concave dish shaped center portion and is formed in the upper central portion thereof, and an upper bearing (51) formed below the large-diameter groove (53). The housing (50) is press-fitted in and fixed to the casing (20), and the inner peripheral surface of the casing (20) and the outer peripheral surface of the ring portion (52) of the housing (50) are hermetically adhered across the entire periphery thereof. In addition, the inside of the casing (20) is divided into an upper space (23) which is a storage space for containing the compression mechanism (40), and a lower space (24) which is a storage space for containing the motor (30), by the housing (50).

The fixed scroll (60) forms a fixing member for fixing to the housing (50). The fixed scroll (60) includes an end plate (61), an outer peripheral portion (62) continuously extending along the outer periphery of the end plate (61), and a wrap (63) placed upright on the front (bottom in FIGS. 1 and 2) of the end plate (61) inward of the outer peripheral portion (62). The end plate (61) is formed in a substantially circular plate shape. The outer peripheral portion (62) is formed so as to protrude downwardly from the end plate (61). The wrap (63) is formed in an involute shape (see FIG. 3). The front end surface of the outer peripheral portion (62) is formed substantially flush with the front end surface of the wrap (63).

The orbiting scroll (70) forms a movable member for making a revolving motion about the fixed scroll (60). The orbiting scroll (70) includes an end plate (71), a wrap (72) of an involute shape formed on the front (upper side in FIGS. 1 and 2) of the end plate (71), and a boss portion (73) of a cylinder shape formed of the back center portion of the end plate (71). The eccentric portion (15) of the drive shaft (11) is inserted into the boss portion (73). Thereby, the orbiting scroll (70) is connected to the motor (30) through the drive shaft (11).

Figure 3:
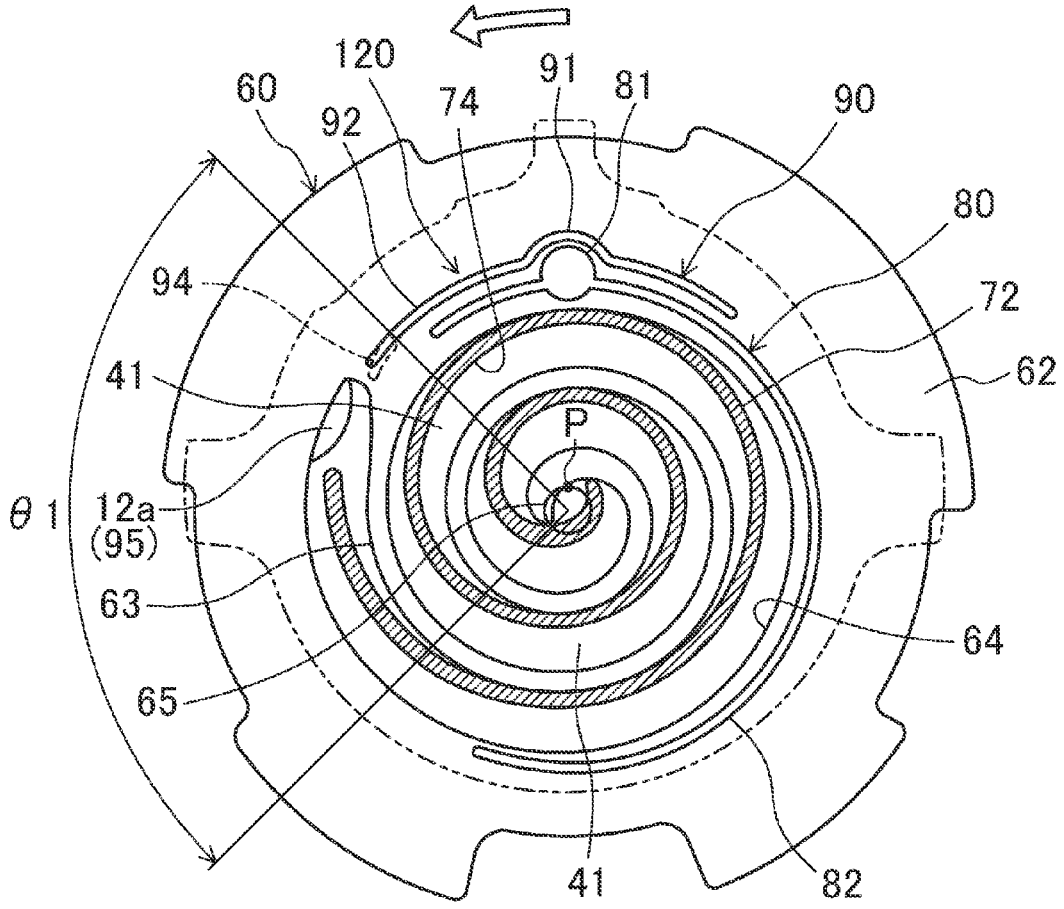
FIG. 3 is a bottom view of a fixed scroll of the first embodiment with a part of an orbiting scroll, and shows the situation in which the rotation angle of the orbiting scroll is approximately 0°.

The compression mechanism (40) is configured such that the wrap (72) of the orbiting scroll (70) and the wrap (63) of the fixed scroll (60) are meshed with each other. In the compression mechanism (40), a compression chamber (411) is formed between the contact portions of the wraps (63, 72) of both scrolls. That is, as illustrated in FIG. 3, in the fixed scroll (60), the wrap groove (64) is formed between the outer peripheral portion (62) and the wrap (63) or between the neighboring wraps (63). Moreover, in the orbiting scroll (70), a wrap groove (74) is formed between the neighboring wraps (72). In the compression mechanism (40), the compression chamber (41) is formed in these wrap grooves (64, 74).

The suction port (12*a*) is formed in the outer peripheral portion (62) of the fixed scroll (60). The suction port (12*a*) is connected to the downstream end of the suction pipe (12). Further, a discharge port (65) is formed in the center of the end plate (61) of the fixed scroll (60). A high-pressure chamber (66) with the discharge port (65) is formed on the back side of the end plate (61) (upper side in FIGS. 1 and 2) of the fixed scroll (60). The high-pressure chamber (66) communicates with the lower space (24) through a passage (not shown) formed in the end plate (61) of the fixed scroll (60) and the housing (50). Thereby, a high pressure atmosphere equivalent to the pressure of the refrigerant discharged from the compression mechanism (40) is formed in the lower space (24).

An oil supply passage (16) extending from the lower end to the upper end is formed in the drive shaft (11). The lower end portion of the drive shaft (11) is immersed in the oil storage portion (21). The lubricating oil of the oil storage portion (21) is supplied to sliding surfaces of the lower bearing (22), the upper bearing (51) and the boss portion (73) etc., through the oil supply passage (16). Further, the lubricating oil is supplied also to the upper side of the drive shaft (11) through the oil supply passage (16) opened to the upper end surface of the drive shaft (11).

Although not shown in drawings, a seal member is installed on the inner peripheral upper surface of the ring portion (52) of the housing (50). The large-diameter groove (53) is hermetically partitioned by the seal member, and this large-diameter groove (53) communicates with the oil supply passage (16) in which high pressure lubricating oil flows. Thereby, a back-pressure portion (42) maintained at a high pressure atmosphere equivalent to the pressure of the refrigerant discharged from the compression mechanism (40) is formed in the large-diameter groove (53). The back-pressure portion (42) applies high pressure to the back side of the end plate (71) of the orbiting scroll (70) to form a pressing mechanism that presses the orbiting scroll (70) toward the fixed scroll (60).

In addition, an intermediate-pressure portion (43) that defines an intermediate-pressure space is provided on the outer periphery of the seal member. That is, an atmosphere of intermediate pressure between the suction pressure and the discharge pressure of the compression mechanism (40) is maintained in the intermediate-pressure portion (43). The intermediate-pressure portion (43) includes a movable side pressure portion (44) and a fixed side pressure portion (45). The movable side pressure portion (44) is formed across the lateral of the end plate (71) from the outer periphery of the end plate (71), which is a part of the back side of the end plate (71) of the orbiting scroll (70). That is, the movable side pressure portion (44) is formed on the outside of the back-pressure portion (42), and the orbiting scroll (70) is pressed toward the fixed scroll (60) at intermediate pressure.

The fixed side pressure portion (45) is formed on the outside of the fixed scroll (60) in the upper space (23), and communicates with the movable side pressure portion (44) through the gap between the outer peripheral portion (62) of the end plate (61) of the fixed scroll (60) and the casing (20).

In addition, a rotation-preventing member (46) of the orbiting scroll (70) is formed in the housing (50). The rotation-preventing member (46) is composed of an Oldham coupling, for example, is installed on the upper side of the ring portion (52) of the housing (50), and is slidably inserted between the end plate (71) of the orbiting scroll (70) and the housing (50).

An adjusting groove (47) for supplying intermediate pressure refrigerant to the intermediate-pressure portion (43) is formed between the fixed scroll (60) and the orbiting scroll (70). The adjusting groove (47) includes a primary passage (48) formed in the fixed scroll (60) and a secondary passage (49) formed in the orbiting scroll (70). The primary passage (48) is formed on the bottom of the outer peripheral portion (62) of the fixed scroll (60), and its inner end is opened to the inner end of the outer peripheral portion (62). The wrap (72) of the orbiting scroll (70) communicates with the intermediate pressure compression chamber (41) formed adjacent to the outer peripheral portion (62).

Meanwhile, the secondary passage (49) penetrates from the front to the back in the outer periphery of the end plate (71) of the orbiting scroll (70), and the upper end thereof communicates intermittently with the outer end portion of the primary passage (48), and the lower end thereof communicates with the intermediate-pressure portion (43) between the orbiting scroll (70) and the housing (50). That is, the intermediate pressure refrigerant is supplied to the intermediate-pressure portion (43) from the intermediate-pressure compression chamber (41), so that an atmosphere of a predetermined intermediate pressure is formed in the intermediate-pressure portion (43).

As illustrated in FIG. 3, a high-pressure side oil groove (80) is formed in the fixed scroll (60). Specifically, the high-pressure side oil groove (80) is formed on the front of the outer peripheral portion (62) of the fixed scroll (60), that is, in a sliding surface for the end plate (71) of the orbiting scroll (70). The high-pressure side oil groove (80) has a vertical hole (81) and a peripheral groove (82). The vertical hole (81) is formed in a circle shape and is opened so as to face the end plate (71) of the orbiting scroll (70). The vertical hole (81) communicates with the back-pressure portion (42) through an oil passage (not shown). Thereby, the high pressure lubricating oil is introduced into the vertical hole (81). The peripheral groove (82) is formed along the inner peripheral edge of the outer peripheral portion (62). The peripheral groove (82) is formed in an inverted C shape with a part of the ring being cut off. The vertical hole (81) is connected continuously in the middle to one end of the peripheral groove (82). That is, the high pressure lubricating oil introduced into the vertical hole (81) is supplied into the peripheral groove (82).

As described above, the high-pressure side oil groove (80) forms a high-pressure groove into which the high pressure lubricating oil corresponding to the discharge pressure of the compression mechanism (40) is introduced. The pressure of the high pressure lubricating oil in the high-pressure side oil groove (80) is applied to the front of the end plate (71) of the orbiting scroll (70). That is, the high-pressure side oil groove (80) forms a pushback mechanism that applies a pushback force to separate the orbiting scroll (70) from the fixed scroll (60).

Further, as illustrated in FIG. 3, a low-pressure groove (90) as a communicating groove is formed on the front of the outer peripheral portion (62) of the fixed scroll (60). The low-pressure groove (90) is formed so as to run along the arc of the high-pressure side oil groove (80) on the outside in a radial direction of the high-pressure side oil groove (80). The low-pressure groove (90) has a small-diameter groove (91) and a large-diameter groove (92). The small-diameter groove (91) and the large-diameter groove (92) are formed in an arc shape. The small-diameter groove (91) has such a shape that encloses a part of the vertical hole (81) of the high-pressure side oil groove (80). The large-diameter groove (92) is formed in parallel with the peripheral groove (82) at the same interval with the peripheral groove (82) of the high-pressure side oil groove (80). One end of the large-diameter groove (92) adjacent to the suction port (12*a*) extends to the position nearer to the suction port (12*a*) than the one end of the peripheral groove (82) adjacent to the suction port (12*a*). The other end of the large-diameter groove (92) extends to the position slightly nearer to the vertical hole (81) than the intermediate portion in a circumferential direction of the peripheral groove (82).

Meanwhile, as illustrated by a broken line in FIG. 3, a communicating concave recess (94) is formed in the orbiting scroll (70). Specifically, the communicating concave recess (94) is formed in the sliding surface for the fixed scroll (60) on the front of the end plate (71) of the orbiting scroll (70). The communicating concave recess (94) of the present embodiment is formed near the suction port (12*a*) and one end of the large-diameter groove (92). When the orbiting scroll (70) revolves, the communicating concave recess (94) is displaced at the same revolution radius with the orbiting scroll (70). Then, the communicating concave recess (94) communicates with both of the suction port (12*a*) and the low-pressure groove (90) at a predetermined first rotational angle range. Thereby, an atmosphere of low pressure equal to the suction port (12*a*) is formed in the low-pressure groove (90). That is, a low-pressure portion filled with fluid at a pressure lower than the discharge pressure of the compression mechanism (40) is formed inside of the suction port (12*a*).

Meanwhile, when the communicating concave recess (94) comes into a predetermined second rotational angle range according to the revolving motion of the orbiting scroll (70), the suction port (12*a*) and the low-pressure groove (90) are blocked. Then, the pressure of the low-pressure groove (90) rises gradually.

The compression mechanism (40) of the present embodiment varies the internal pressure of the low-pressure groove (90) by alternately performing the communication between the low-pressure groove (90) and the suction port (12*a*) and the blocking between the low-pressure groove (90) and the suction port (12*a*), at every one rotation of the orbiting scroll (70). By this, the upsetting moment of the orbiting scroll (70) is reduced, especially in the first rotational angle range in which the upsetting moment of the orbiting scroll (70) is apt to increase. That is, in the scroll compressor (10) of the present embodiment, the adjusting mechanism (120) for inhibiting the fluctuation of the upsetting moment of the orbiting scroll (70) is composed of the low-pressure groove (90), the communicating concave recess (94) and the suction port (12*a*) (the details of the operation of the adjusting mechanism will be described later).

First, basic operations of the scroll compressor (10) will be described.

When the motor (30) is driven, the orbiting scroll (70) of the compression mechanism (40) rotates. Since the rotation of the orbiting scroll (70) is prevented by the rotation-preventing member (46), the orbiting scroll (70) performs only a revolving motion about the center of the drive shaft (11) without performing rotation. According to the revolving motion of the orbiting scroll (70), the volume of the compression chamber (41) is reduced to the center side, and the compression chamber (41) compresses the gas refrigerant sucked from the suction pipe (12). The gas refrigerant with compression completed is discharged to the high-pressure chamber (66) through the discharge port (65) of the fixed scroll (60). The high pressure refrigerant gas of the high-pressure chamber (66) flows to the lower space (24) through the passage of the fixed scroll (60) and the housing (50). In addition, the refrigerant of the lower space (24) is discharged out of the casing (20) through the discharge pipe (13).

The lower space (24) of the casing (20) maintains the refrigerant being discharged in a high pressure condition, and also maintains the lubricating oil of the oil storage portion (21) in a high pressure condition. The high pressure lubricating oil of the oil storage portion (21) flows from the lower end of the oil supply passage (16) of the drive shaft (11) to the upper end thereof, and flows out from the upper end opening of the eccentric portion (15) of the drive shaft (11) into the boss portion (73) of the orbiting scroll (70). The oil supplied to the boss portion (73) lubricates the sliding surface between the boss portion (73) and the eccentric portion (15) of the drive shaft (11). Therefore, the back-pressure portion (42) from the inside of the boss portion (73) comes to have a high pressure atmosphere equivalent to discharge pressure. By this high pressure, the orbiting scroll (70) is pressed toward the fixed scroll (60).

With the wrap (72) of the orbiting scroll (70) in contact with the outer peripheral portion (62) of the fixed scroll (60), the compression chamber (41) is formed on the inner peripheral side of the outer peripheral portion (62) of the fixed scroll (60). The compression chamber (41) has the volume contracted as it moves to the central portion. The primary passage (48) of the adjusting groove (47) communicates with the compression chamber (41) of the outermost periphery of the primary passage (48), so when the compression chamber (41) comes to have the condition of a predetermined intermediate pressure, the secondary passage (49) of the adjusting groove (47) comes to communicate with the primary passage (48). As a result, the refrigerant of intermediate pressure is supplied to the movable side pressure portion (44), and is supplied to the fixed side pressure portion (45), so that the back outer side of the orbiting scroll (70) and the outer periphery of the fixed scroll (60) come to have an intermediate pressure atmosphere. The orbiting scroll (70) is pressed toward the fixed scroll (60) by these intermediate pressure and high pressure.

If the orbiting scroll (70) is pressed toward the fixed scroll (60) by the above-described pressing mechanism, there is a case that the pressing force of the orbiting scroll (70) becomes excessive. For example, according to the operating conditions of the refrigeration system, the pressing force of the orbiting scroll (70) resulting from the high pressure is apt to become excessive under the operating condition that the pressure differential between high and low pressure regions of the refrigerant circuit is large. At this time, when the pressing force of the orbiting scroll (70) becomes excessive, the sliding resistance between the orbiting scroll (70) and the fixed scroll (60) increases, so problems such as an increase in the loss of mechanical power or acceleration in the abrasion of the sliding portions occur. Therefore, the present embodiment is provided with a pushback mechanism to avoid such excessive pressing.

Specifically, in the present embodiment, the back-pressure portion (42) and the high-pressure side oil groove (80) communicate with each other, so that the high pressure lubricating oil of the back-pressure portion (42) is appropriately supplied to the high-pressure side oil groove (80). Therefore, under the operating condition that the pressure differential between high and low pressure regions of the refrigerant circuit is large, the internal pressure of the high-pressure side oil groove (80) rises much higher. The high pressure of the high-pressure side oil groove (80) is applied to the front of the end plate (71) of the orbiting scroll (70). Thereby, the orbiting scroll (70) is pushed back to be separated from the fixed scroll (60) against the pressing force of the pressing mechanism. As a result, it is avoided in advance that the pressing force of the orbiting scroll (70) becomes excessive, and furthermore the sliding resistance of both scrolls (60, 70) can be alleviated.

Further, in the compression mechanism (40), the upsetting moment of the orbiting scroll (70) increases, if the orbiting scroll (70) reaches a certain rotational angle, due to the above-mentioned pushback force by the high-pressure side oil groove (80), or the thrust load or the radial load resulting from the internal pressure of the compression chamber (41). In the present embodiment, based on the state (rotational angle=0°) in which the eccentric center of the orbiting scroll (70) becomes a point P in FIG. 3 (that is, the orbiting scroll (70) is positioned near the uppermost side in FIG. 3), the range of the rotational angle for reducing the upsetting moment of the orbiting scroll (70) (first rotational angle range θ1) is set in a range of 45° to 135°, in the case that the orbiting scroll (70) revolves in a counterclockwise direction in FIG. 3. That is, in this compression mechanism (40), due to the above-described pushback force, thrust load, and radial load, for example, the upsetting moment reaches a maximum especially at a position where the rotational angle is near 90°. Thus, in the present embodiment, the upsetting moment is reduced by the adjusting mechanism (120) in a predetermined angle range (±45°) based on this rotational angle of 90°, and the upsetting moment is not to be reduced in the remaining rotational angle range (second rotational angle range (rotational angle of 0° to 45° and 135° to 360°)).

Figure 4:
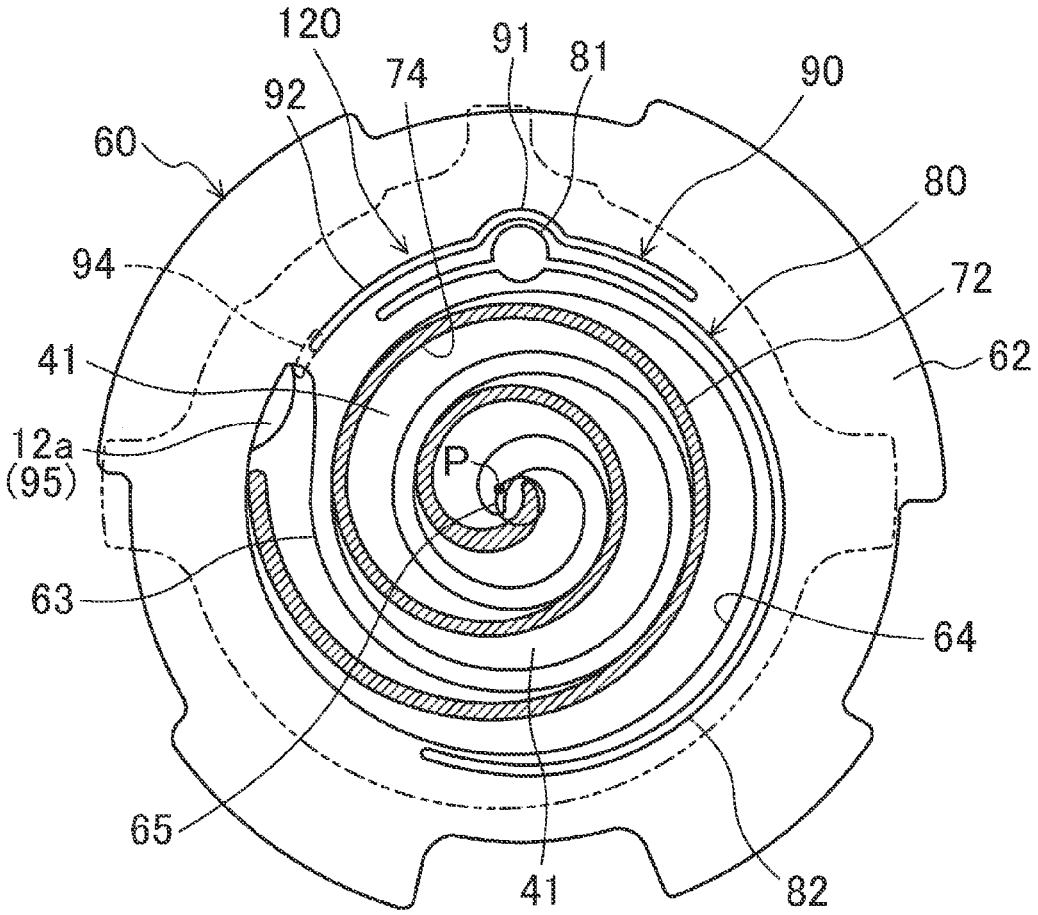
FIG. 4 is a bottom view of the fixed scroll of the first embodiment with a part of the orbiting scroll, and shows the situation in which the rotation angle of the orbiting scroll is approximately 90°.

Specifically, in the state of the rotational angle of 0° illustrated in FIG. 3, for example, the communicating concave recess (94) is overlapped with the low-pressure groove (90) in the axial direction so as to communicate with each other, but the communicating concave recess (94) and the suction port (12*a*) do not communicate with each other yet. From this state, when the orbiting scroll (70) revolves in the arrow direction of FIG. 3 and the rotational angle exceeds 45°, the suction port (12*a*) and the low-pressure groove (90) start to communicate with each other through the communicating concave recess (94). In the state of the rotational angle of 90° illustrated in FIG. 4, the suction port (12*a*) and the low-pressure groove (90) communicate with each other completely. In this state, the pressure in the low-pressure groove (90) becomes equal to the suction pressure of the suction port (12*a*). Thereby, the end plate (71) of the orbiting scroll (70) facing the low-pressure groove (90) of the fixed scroll (60) is sucked toward the low-pressure groove (90) and is attracted toward the fixed scroll (60). Thereby, a moment force in the reverse direction from the original upsetting moment is applied to the orbiting scroll (70) to offset this upsetting moment. Such attraction of the orbiting scroll (70) by the low-pressure groove (90) continues until the rotational angle of the orbiting scroll (70) reaches 135°.

Figure 5:
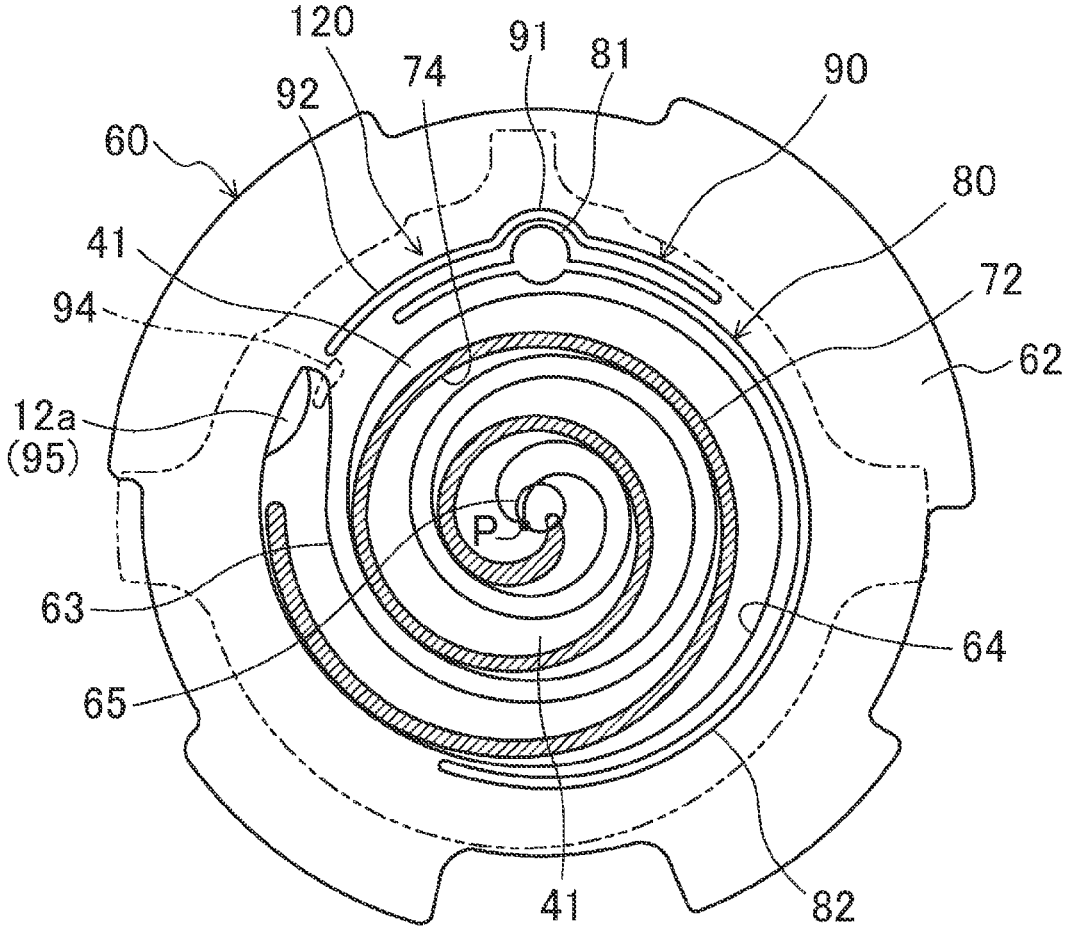
FIG. 5 is a bottom view of the fixed scroll of the first embodiment with a part of the orbiting scroll, and shows the situation in which the rotation angle of the orbiting scroll is approximately 135°.
Figure 6:
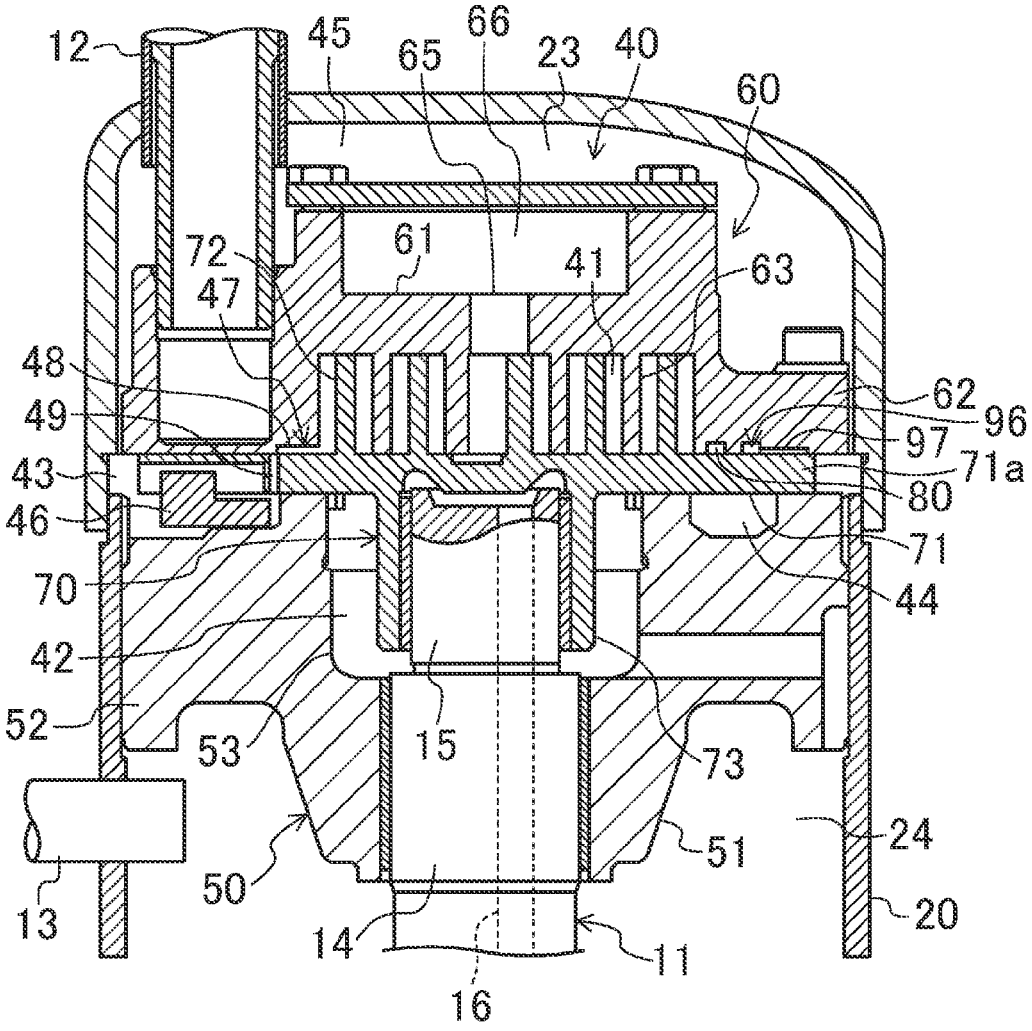
FIG. 6 is a longitudinal cross-sectional view of an essential part of a scroll compressor of a second embodiment, and shows the situation in which the rotation angle of an orbiting scroll is approximately 0°.
Figure 7:
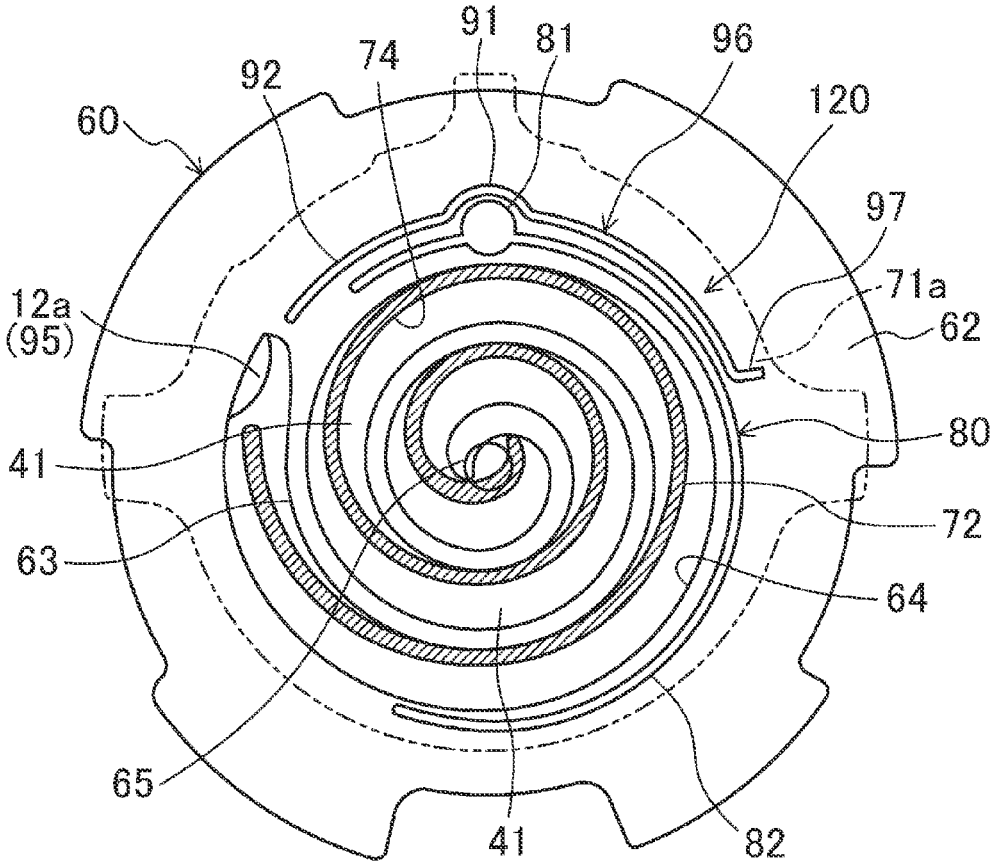
FIG. 7 is a bottom view of a fixed scroll of the second embodiment with a part of the orbiting scroll, and shows the situation in which the rotation angle of the orbiting scroll is approximately 0°.
Figure 8:
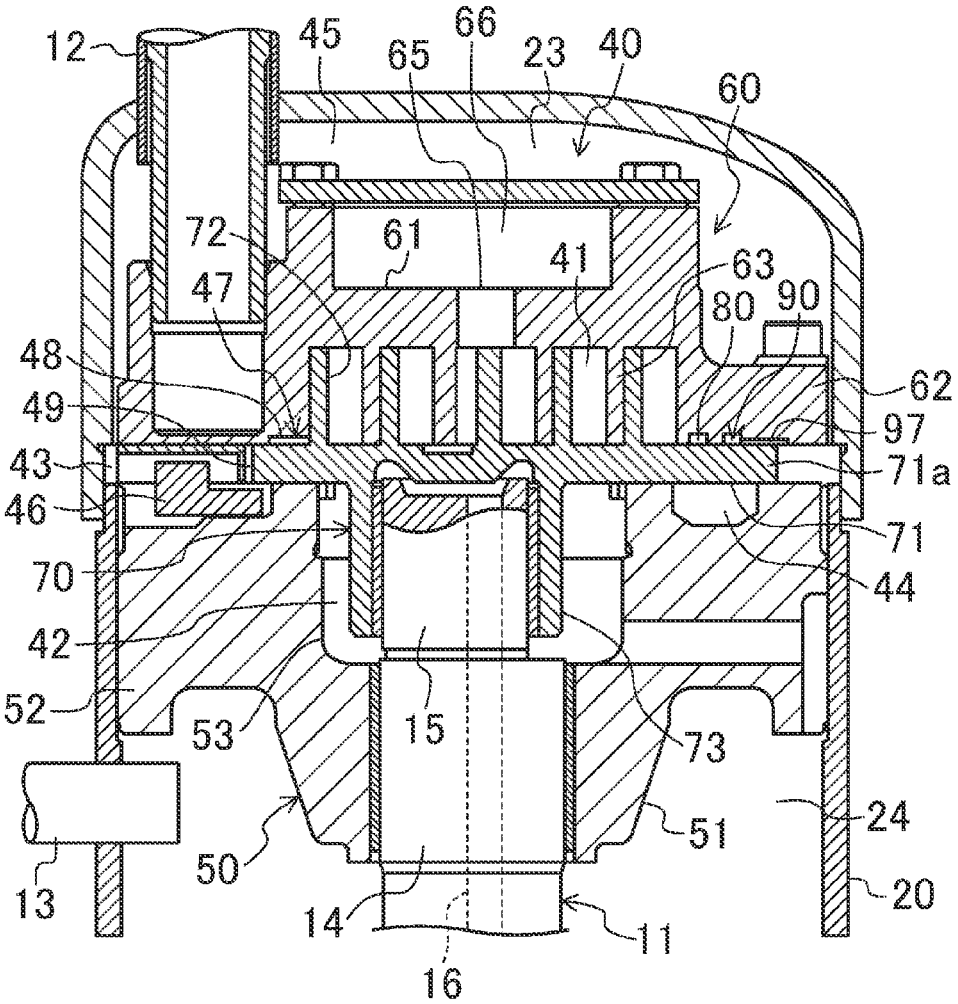
FIG. 8 is a longitudinal cross-sectional view of an essential part of the scroll compressor of the second embodiment, and shows the situation in which the rotation angle of the orbiting scroll is approximately 90°.
Figure 9:
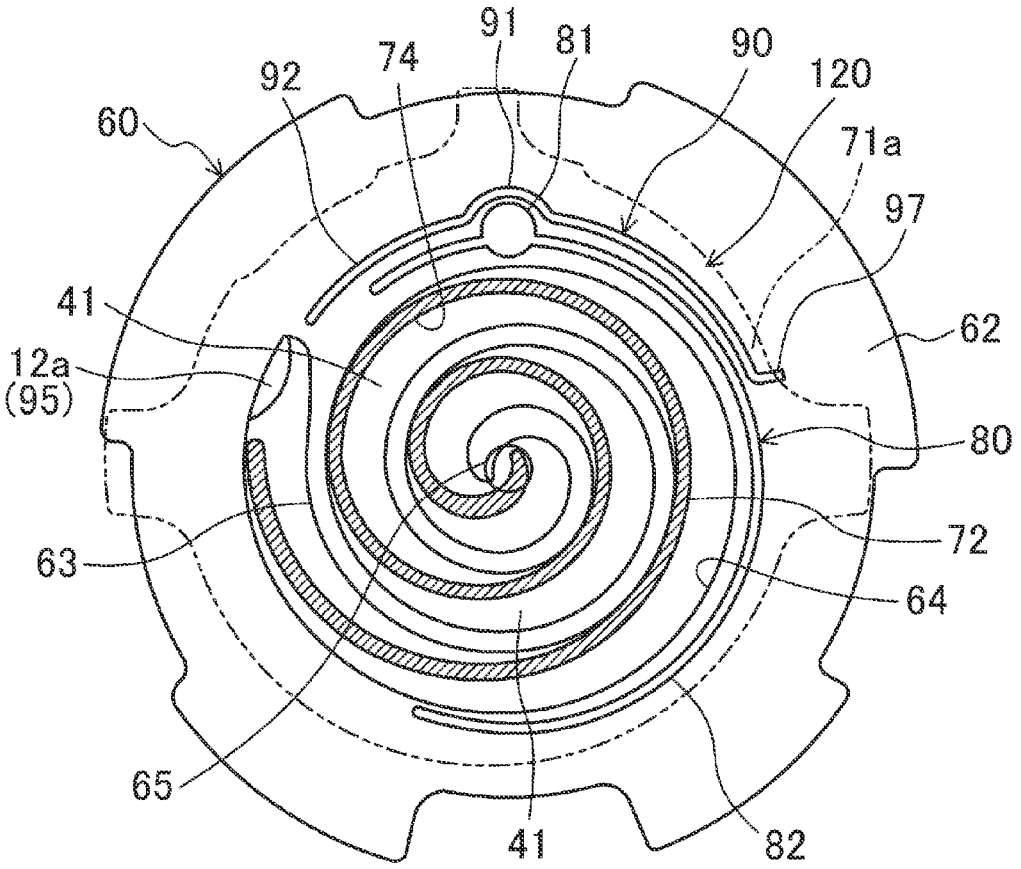
FIG. 9 is a bottom view of the fixed scroll of the second embodiment with a part of the orbiting scroll, and shows the situation in which the rotation angle of the orbiting scroll is approximately 90°.

As illustrated in FIG. 5, when the rotational angle of the orbiting scroll (70) exceeds 135°, the communicating concave recess (94) and the low-pressure groove (90) are blocked. Thereby, the high pressure lubricating oil or gas refrigerant in the vicinity enters into the low-pressure groove (90) to make the internal pressure of the low-pressure groove (90) rise. Therefore, in such a rotational angle range (that is, the second rotational angle range), negative pressure for canceling the upsetting moment does not act on the end plate (71) of the orbiting scroll (70).

As described above, during the revolution of the orbiting scroll (70), the first rotational angle range and the second rotational angle range are displaced alternately by the orbiting scroll (70), thereby the internal pressure of the low-pressure groove (90) is varied as well. At this time, when the above-described lubricating oil of the high-pressure side oil groove (80) flows outside in the radial direction, this lubricating oil is collected in the low-pressure groove (90). The lubricating oil collected in the low-pressure groove (90) flows out to the suction port (12*a*) when the orbiting scroll (70) is placed within the first rotational angle range. Therefore, the oil that flowed out from the high-pressure side oil groove (80) can be used for lubricating each sliding portion of the compression chamber (41) or sealing each gap.

If the lubricating oil of the high-pressure side oil groove (80) is not collected in the low-pressure groove (90) and flows on the outside in the radial direction of the fixed scroll (60) or the orbiting scroll (70), this lubricating oil is accumulated in the vicinity of the rotation preventing member (Oldham coupling (46)), and the lubricating oil forms resistance against the Oldham coupling (46), so that the loss of mechanical power increases. However, as described above, since the oil that flowed out from the high-pressure side oil groove (80) is collected in the low-pressure groove (90), such an increase of mechanical power can be prevented.

As described above, according to the first embodiment, because the low-pressure groove (90) and the suction port (12*a*) are made to communicate with each other in the first rotational angle range θ1 in which the upsetting moment of the orbiting scroll (70) is apt to increase, it is possible to lower the internal pressure of the low-pressure groove (90) in the first rotational angle range θ1. Thereby, it is possible to attract the orbiting scroll (70) toward the low-pressure groove (90) and reduce the upsetting moment. Therefore, it is possible to avoid the upsetting of the orbiting scroll (70), the leaking of refrigerant from the gap and suction superheating of refrigerant as well.

Further, in the first embodiment, since the low-pressure groove (90) is formed on the outside in the radial direction of the high-pressure side oil groove (80) composing the pushback mechanism, the oil that flowed out from the high-pressure side oil groove (80) can be collected in the low-pressure groove (90). Since the oil collected in the low-pressure groove (90) is supplied to the compression chamber (41) from the suction port (12*a*), this oil can be reused for sealing the gap or for lubricating the sliding portions. Further, it is also possible to avoid the increase of mechanical loss generated as the oil that flowed out from the high-pressure side oil groove (80) overflows near the Oldham coupling (46).

Further, in the first embodiment, the communicating concave recess (94) is formed in the end plate (71) of the orbiting scroll (70), and by eccentrically rotating the communicating concave recess (94), the communicating state of the suction port (12*a*) and the low-pressure groove (90) is changed. Therefore, it is possible to adjust the range (first rotational angle range) for canceling the upsetting moment appropriately according to the forming position of the communicating concave recess (94).

Second Embodiment

A scroll compressor (10) according to the second embodiment is different in the configuration of the adjusting mechanism from that of the first embodiment described above. Specifically, an adjusting mechanism of the second embodiment illustrated in FIGS. 6 to 9 has an intermediate-pressure groove (96) formed in the outer periphery of the high-pressure side oil groove (80). An intermediate-pressure groove (96) has an open groove (97) extending outward in the radial direction in addition to the same small-diameter groove (91) and the large-diameter groove (92) as in the first embodiment. The open groove (97) communicates with the other end of the large-diameter groove (92) and is opened toward an end plate (71) of an orbiting scroll (70). In the second embodiment, the outer peripheral end of the end plate (71) of the orbiting scroll (70) forms a closed portion (71*a*) that is displaced to be able to open and close the open groove (97).

In the second embodiment, the intermediate-pressure portion (43) is formed around the vicinity of the open groove (97) and the closed portion (71*a*). The intermediate-pressure portion (43) composes a pressure-forming portion to define a low-pressure space (strictly speaking, an intermediate-pressure space between the suction pressure and the discharge pressure of a compression mechanism (40)) filled with a fluid of lower pressure than the discharge pressure of the compression mechanism (40).

In the second embodiment, the intermediate-pressure groove (96) and the intermediate-pressure portion (43) are to be able to communicate with each other according to the revolving motion of the orbiting scroll (70). Specifically, when the rotational angle of the orbiting scroll (70) comes into the first rotational angle range (45° to 135°), for example, the lower end opening of the open groove (97) is opened from the closed portion (71*a*) of the orbiting scroll (70). Thereby, the intermediate-pressure portion (43) around the closed portion (71*a*) and the open groove (97) communicate with each other to make the pressure of the intermediate-pressure groove (96) lower (see FIGS. 8 and 9, for example). Thereby, the end plate (71) of the orbiting scroll (70) is attracted toward the intermediate-pressure groove (96) to reduce the upsetting moment of the orbiting scroll (70).

Meanwhile, when the rotational angle of the orbiting scroll (70) comes into the second rotational angle range (0° to 45° and 135° to 360°), the lower end opening of the open groove (97) is closed by the closed portion (71*a*) of the orbiting scroll (70). Thereby, the intermediate-pressure portion (43) and the intermediate-pressure groove (96) are blocked to make the internal pressure of the intermediate-pressure groove (96) rise gradually (see FIGS. 6 and 7).

Further, in the second embodiment, the intermediate-pressure groove (96) to come to have an intermediate pressure is used as a communicating groove of the adjusting mechanism. However, the surroundings of the open groove (97) may have an atmosphere of low-pressure (suction pressure) and the communicating groove may be composed of the low-pressure groove (90), likewise with the first embodiment. Further, also in the second embodiment, the lubricating oil that flowed out from the high-pressure side oil groove (80) can be collected in the intermediate-pressure groove (96).

Third Embodiment

A scroll compressor (10) according to the third embodiment is different in the configuration of the adjusting mechanism from those of the first embodiment and the second embodiment described above. Specifically, in an adjusting mechanism of the third embodiment illustrated in the FIGS. 10 to 13, a through hole (98) extending in the axial direction is formed in an end plate (71) of an orbiting scroll (70). The through hole (98) is formed nearby on the outside in the radial direction of the end plate (71), and faces the bottom side (sliding surface) of an outer peripheral portion (62) of a fixed scroll (60). The through hole (98) is eccentrically rotated with the orbiting scroll (70). Here, an intermediate-pressure groove (96) forming a communicating groove is positioned on a trajectory t of the eccentric rotation of the through hole (98).

A movable side pressure portion (44) forming a part of the intermediate-pressure portion (43) is formed below the through hole (98). The movable side pressure portion (44) composes a pressure forming portion to define a low-pressure space (strictly speaking, an intermediate-pressure space between the suction pressure and the discharge pressure of a compression mechanism (40)) filled with a fluid of lower pressure than the discharge pressure of the compression mechanism (40). The movable side pressure portion (44) is formed in a range including the eccentric trajectory t of the through hole (98) so as to communicate with the through hole (98) at all times.

In the third embodiment, the intermediate-pressure groove (96) and the movable side pressure portion (44) are made to be able to communicate with each other according to the revolving motion of the orbiting scroll (70). Specifically, when the rotational angle of the orbiting scroll (70) comes into the first rotational angle range (for example, 90°), the intermediate-pressure groove (96) and the movable side pressure portion (44) come to communicate with each other through the through hole (98) (see FIGS. 12 and 13, for example). Thereby, the pressure of the intermediate-pressure groove (96) is lowered, and the end plate (71) of the orbiting scroll (70) is attracted toward the intermediate-pressure groove (96). As a result, the upsetting moment of the orbiting scroll (70) is reduced.

Figure 10:
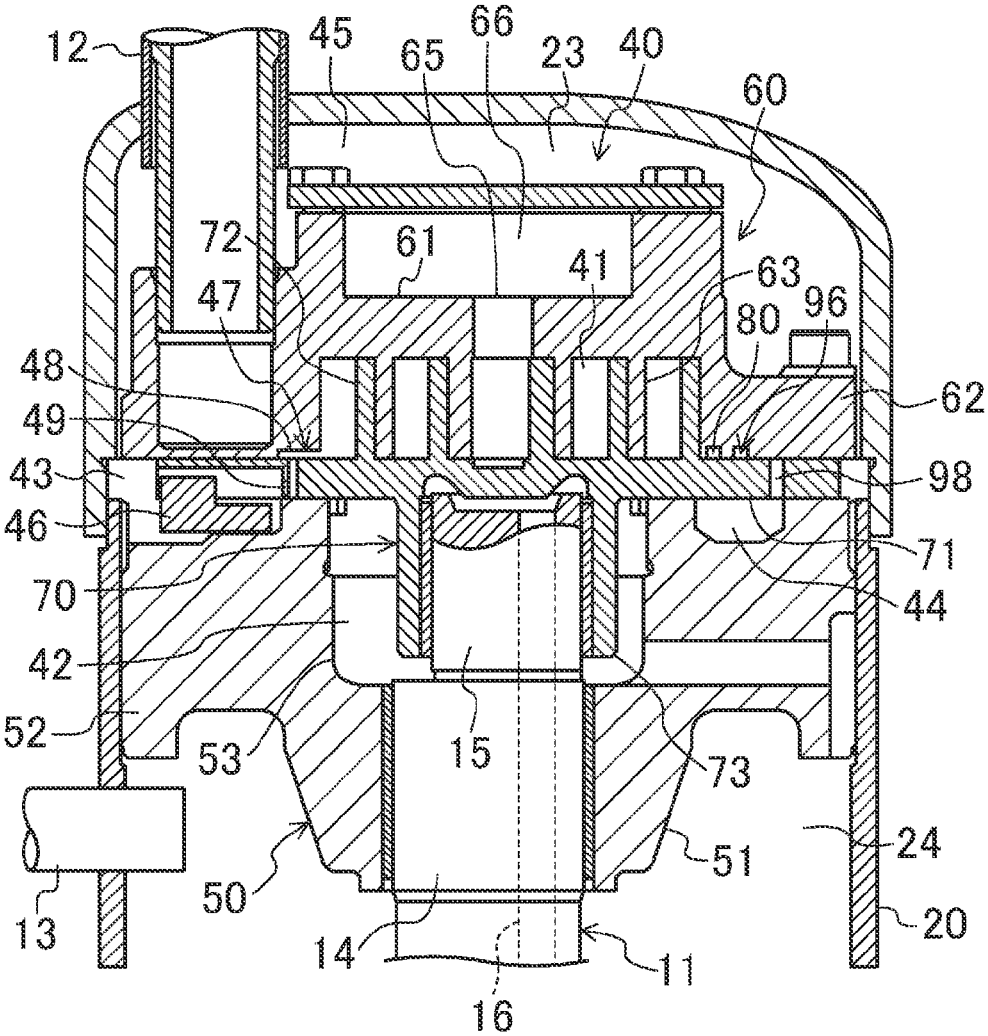
FIG. 10 is a longitudinal cross-sectional view of an essential part of a scroll compressor of a third embodiment, and shows the situation in which the rotation angle of an orbiting scroll is approximately 270°.
Figure 11:
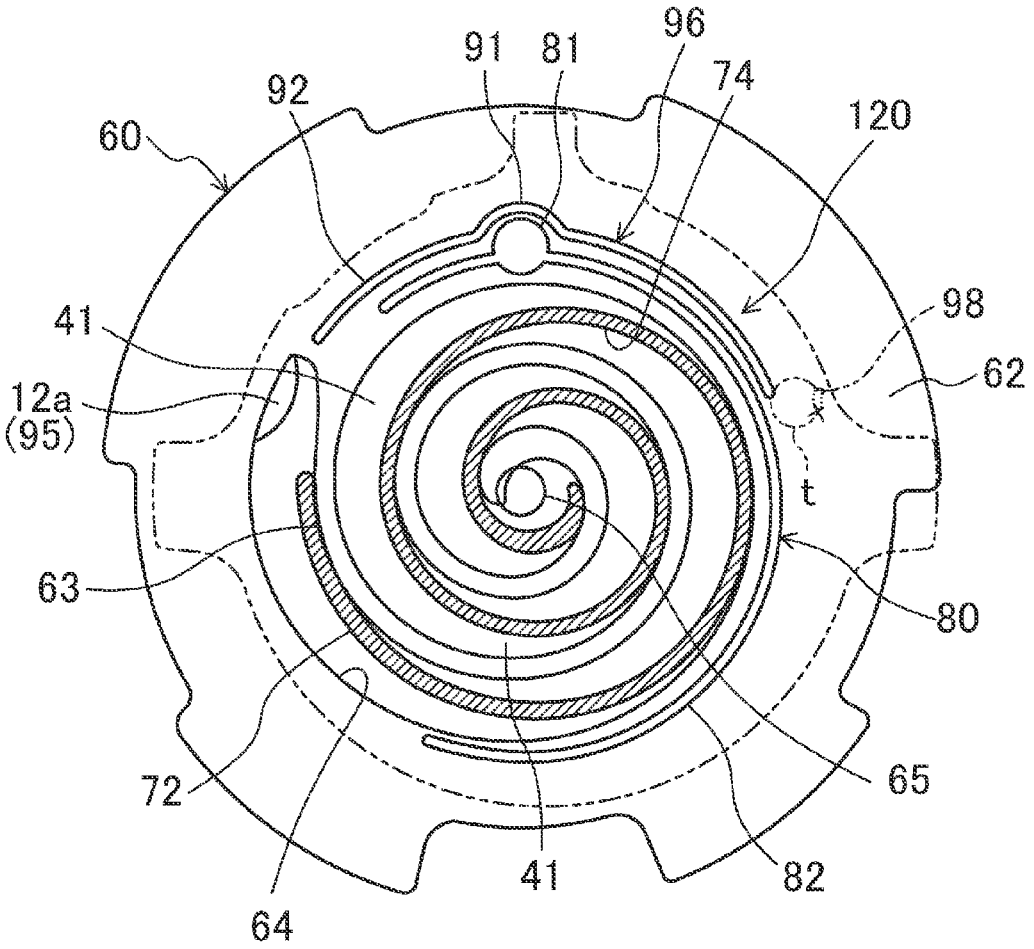
FIG. 11 is a bottom view of a fixed scroll of the third embodiment with a part of the orbiting scroll, and shows the situation in which the rotation angle of the orbiting scroll is approximately 270°.
Figure 12:
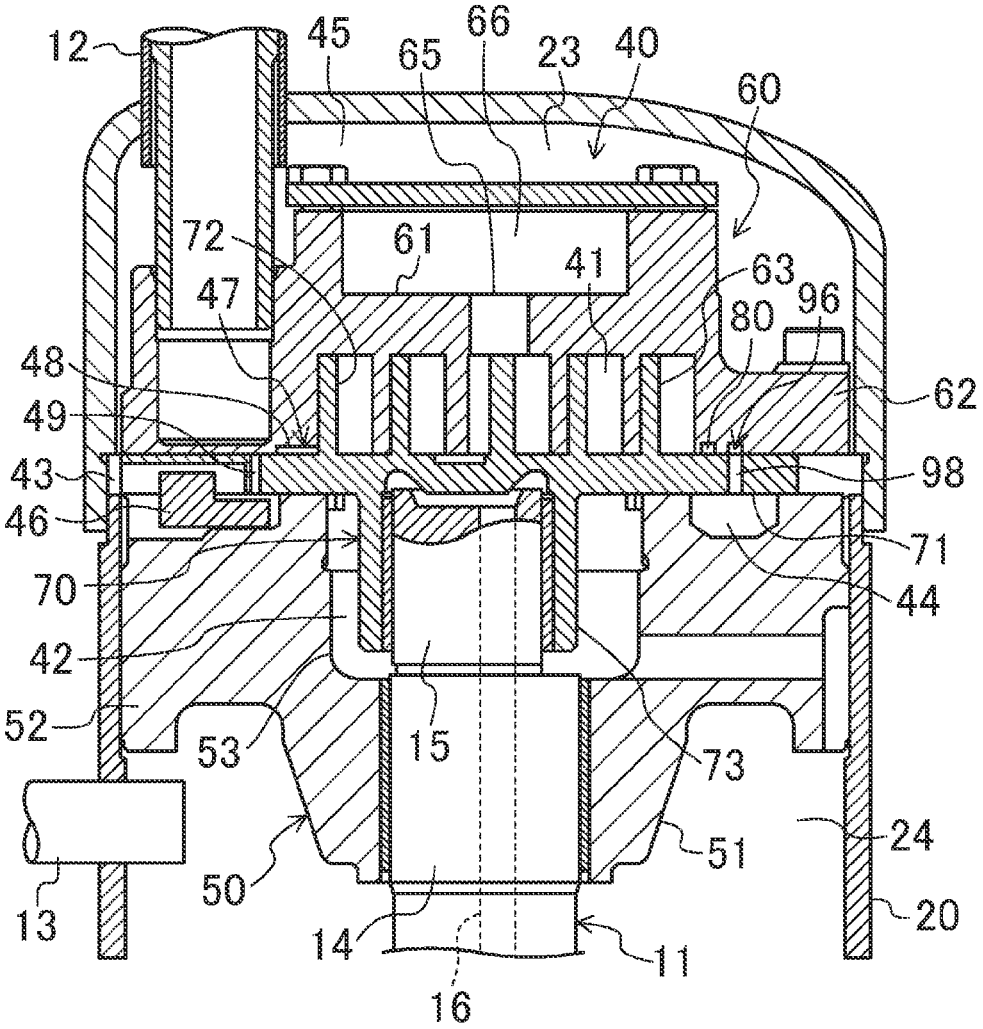
FIG. 12 is a longitudinal cross-sectional view of an essential part of the scroll compressor of the third embodiment, and shows the situation in which the rotation angle of the orbiting scroll is approximately 90°.
Figure 13:
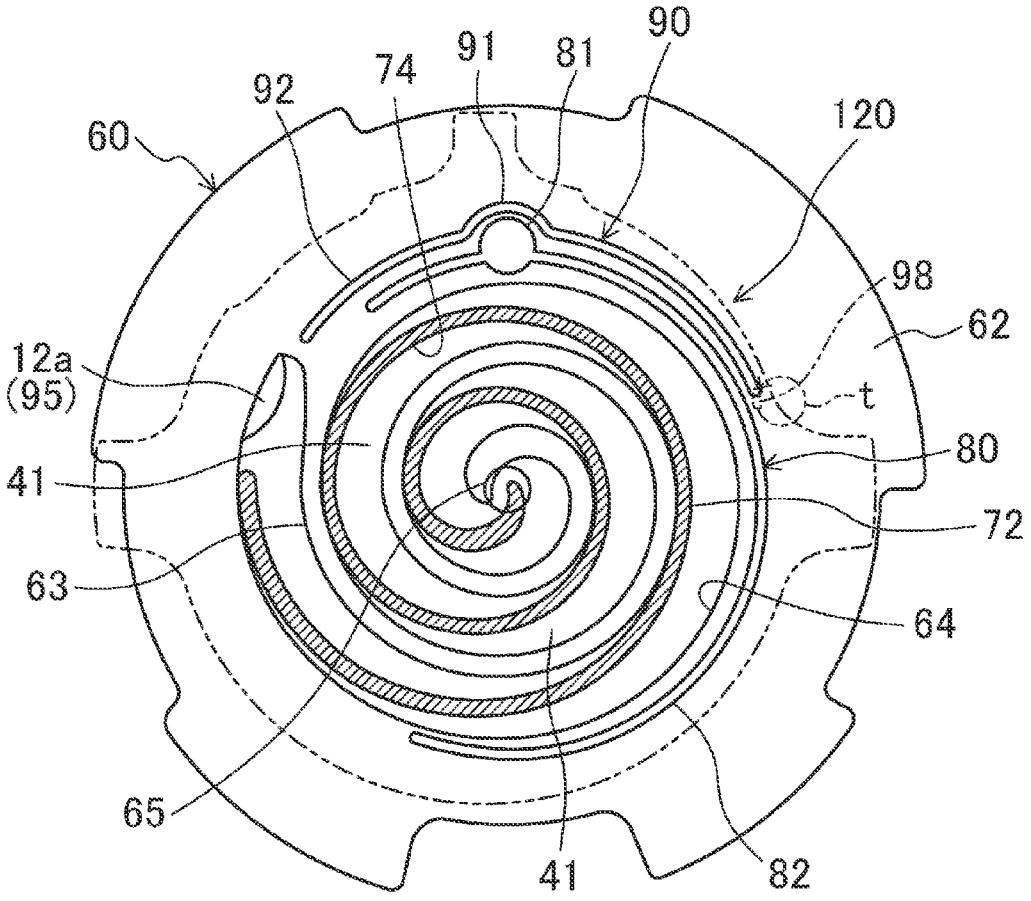
FIG. 13 is a bottom view of the fixed scroll of the third embodiment with a part of the orbiting scroll, and shows the situation in which the rotation angle of the orbiting scroll is approximately 90°.

Meanwhile, when the rotational angle of the orbiting scroll (70) comes into the second rotational angle range (for example, 270°), the intermediate-pressure groove (96) and the movable side pressure portion (44) are blocked (see FIGS. 10 and 11, for example). Thereby, the pressure of the intermediate-pressure groove (96) rises gradually.

Further, in the third embodiment as well, the intermediate-pressure groove (96) to come to have the intermediate pressure is used as a communicating groove of the adjusting mechanism, but the surroundings of the open groove (97) may have a low pressure (suction pressure) and the communicating groove of the adjusting mechanism may be composed of the low-pressure groove (90). Further, in the third embodiment as well, the lubricating oil that flowed out from the high-pressure side oil groove (80) can be collected in the intermediate-pressure groove (96).

Variations of the Third Embodiment

The third embodiment may also be configured as the following variations.

First Variation

Figure 14:
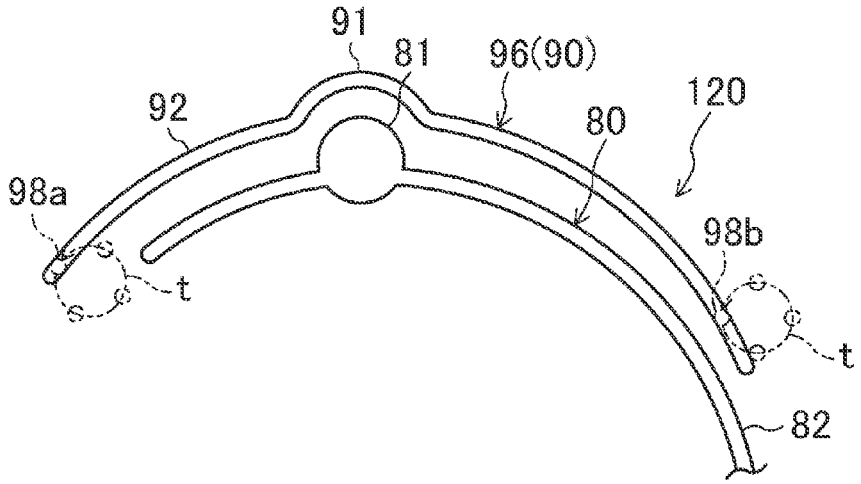
FIG. 14 is a view schematically illustrating an adjusting mechanism and a pushback mechanism according to a first variation of the third embodiment.

A first variation illustrated schematically in FIG. 14 is provided with an intermediate-pressure groove (96) (or low-pressure groove (90) forming a communicating groove and two through holes (98*a*, 98*b*) each providing intermittent communication). Specifically, in the first variation, first through holes (98*a*) are formed on one end side of a large-diameter groove (92), and second through holes (98*b*) are formed on the other end side of the large-diameter groove (92). One end side of each first through hole (98*a*) in the axial direction communicates intermittently with the large-diameter groove (92), while the other end side thereof in the axial direction communicates with a low-pressure space (for example, a movable side pressure portion (44)). In the first variation, the movable side pressure portion (44) and the large-diameter groove (92) communicate with the first through hole (98*a*) or the second through hole (98*b*) in a predetermined first rotational angle range according to the revolving motion of the orbiting scroll (70), so that the pressure of the intermediate-pressure groove (96) (or low-pressure groove (90)) is lowered. Thereby, likewise with the third embodiment described above, the upsetting moment can be reduced by attracting the orbiting scroll (70). Meanwhile, it is not always necessary to make the timing for communicating the first through hole (98*a*) and the communicating grooves (90, 96) coincide with the timing for communicating the second through hole (98*b*) and the communicating grooves (90, 96). The position of each through hole (98*a*, 98*b*) can be set to shift these timings according to the upsetting moment generated.

Second Variation

Figure 15:
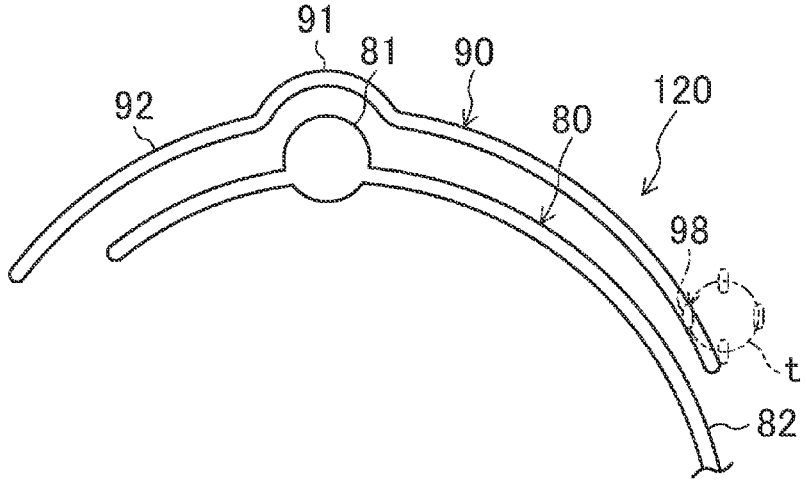
FIG. 15 is a view schematically illustrating an adjusting mechanism and a pushback mechanism according to a second variation of the third embodiment.

In the second variation illustrated schematically in FIG. 15, a through hole (98), which becomes an elliptical shape in a cross-sectional view perpendicular to an axial direction thereof, is formed on an end plate (71) of an orbiting scroll (70). By having such a shape in which the through hole (98) is longitudinally long, it becomes possible to extend the time for communicating grooves (90, 96) to communicate continuously with the through hole (98). As a result, it is possible to facilitate the lowering of the internal pressure of the communicating grooves (90, 96).

Third Variation

Figure 16:
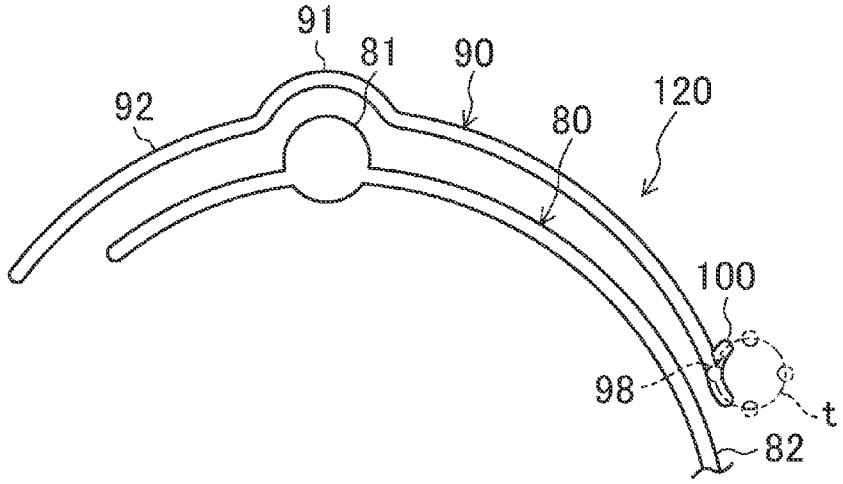
FIG. 16 is a view schematically illustrating an adjusting mechanism and a pushback mechanism according to a third variation of the third embodiment.

In the third variation illustrated schematically in FIG. 16, an extended arc groove (100) is formed in the end portion (right end portion in FIG. 16) of a large-diameter groove (92) of communicating grooves (90, 96). The extended arc groove (100) is formed in an arc shape that is axially overlapped with a part of the eccentric trajectory t so as to imitate the eccentric trajectory t of the through hole (98). The third variation, as it is provided with the extended arc groove (100), can easily extend the communicating time between the through hole (98) and the communicating grooves (90, 96). As a result, it is possible to facilitate the lowering of the internal pressure of the communicating grooves (90, 96).

Other Variations

The above-described variations may also be configured as follows.

Figure 17:
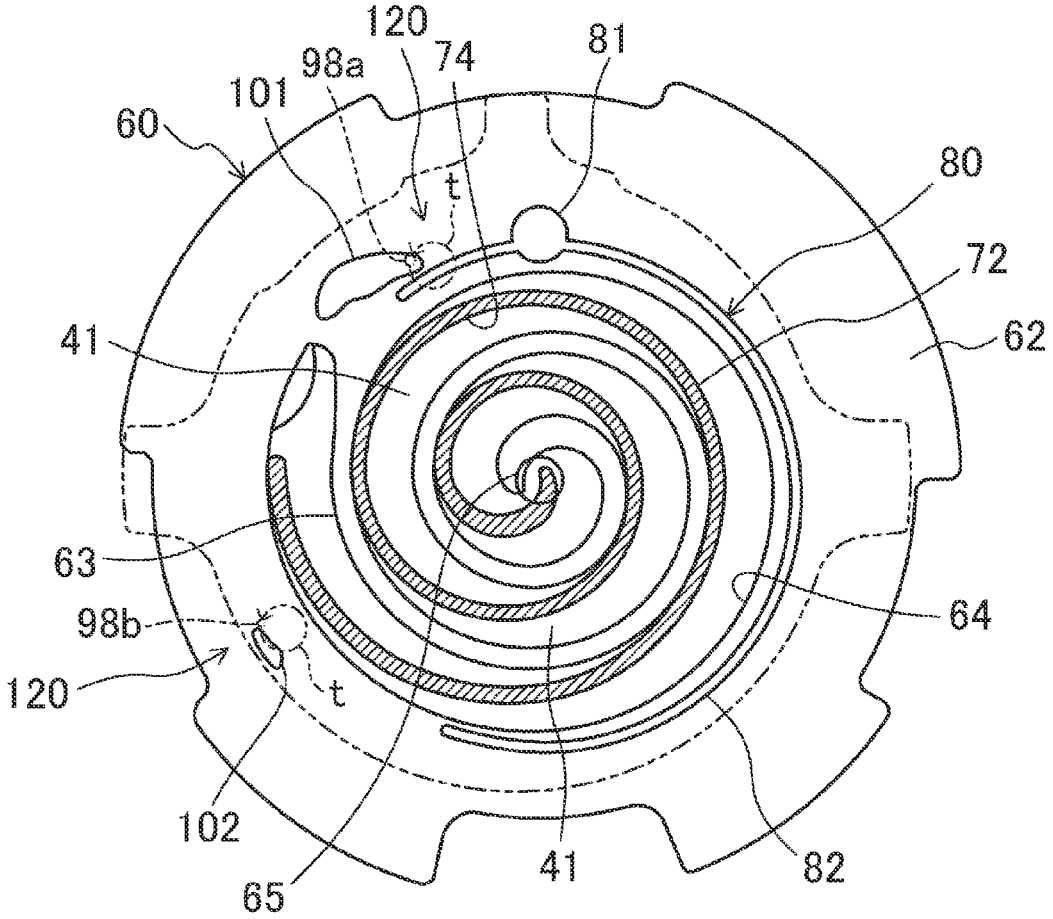
FIG. 17 is a bottom view of a fixed scroll of another embodiment with a part of an orbiting scroll, and shows the situation in which the rotation angle of the orbiting scroll is approximately 90°.

In each above-described variation, the communicating grooves (90, 96) forming the intermediate pressure or the low pressure are formed in an arc shape. However, as illustrated in FIG. 17, for example, the communicating groove is not limited thereto. For example, in the example illustrated in FIG. 17, the shape and arrangement of the communicating grooves are set such that the upsetting moment of an orbiting scroll (70) can be canceled efficiently. Meanwhile, in the example of FIG. 17, two communicating grooves (101, 102) of almost an ellipse shape or almost a cocoon shape are formed on the front (sliding surface) of an outer peripheral portion (62) of a fixed scroll (60), and through holes (98*a*, 98*b*) corresponding to these communicating grooves (101, 102) are formed on an end plate (71) of an orbiting scroll (70).

Further, the above-described scroll compressor (10) is applied to a refrigeration system having a refrigerant circuit, but as long as it is to compress fluid, it may be applied to other apparatuses.

The above embodiments are merely preferable examples, and are not intended to limit the scope of the present invention, applicable subjects, or usage.

As described above, the present invention relates to the scroll compressor, and it is useful especially for the upsetting prevention measure of an orbiting scroll.

What is claimed is:

1. A scroll compressor comprising:

a casing;

a compression mechanism contained in the casing, the compression mechanism including a fixed scroll having an end plate portion, an outer peripheral portion formed on an outer periphery of the end plate portion, and a wrap placed upright inside the outer peripheral portion, and an orbiting scroll having an end plate portion slidably contacting with the outer peripheral portion of the fixed scroll and a front end portion of the wrap of the fixed scroll, and a wrap placed upright on the end plate portion;

a pressing mechanism arranged to apply a pressing force toward the fixed scroll to a back side of the end plate portion of the orbiting scroll;

a pushback mechanism arranged to apply a pushback force separating the orbiting scroll from the fixed scroll to a front of the end plate portion of the orbiting scroll; and at least one adjusting mechanism having a low-pressure portion filled with a fluid of lower pressure than a discharge pressure of the compression mechanism, and a communicating groove formed in a sliding surface of the outer peripheral portion of the fixed scroll so as to communicate with the low-pressure portion in a first rotational angle range in order to reduce an upsetting moment of the orbiting scroll, and to be blocked from the low-pressure portion in a second rotational angle range other than the first rotational angle range;

the pushback mechanism including a high-pressure side oil groove formed in the sliding surface of the outer peripheral portion of the fixed scroll to carry a flow of a lubricating oil with a high pressure corresponding to the discharge pressure of the compression mechanism, the communicating groove being formed outside of the high-pressure side oil groove in a radial direction, and oil in the high-pressure side oil groove flowing outside in the radial direction and being collected in the communicating groove.

2. The scroll compressor of claim 1, wherein the high-pressure side oil groove is formed in an arc shape extending in a circumferential direction of the fixed scroll, and the communicating groove is formed in an arc shape so as to run along an arc of the high-pressure side oil groove.

* * * * *